US010161610B2

(12) United States Patent
Quilici et al.

(10) Patent No.: US 10,161,610 B2
(45) Date of Patent: Dec. 25, 2018

(54) SOLID-STATE LUMINAIRE WITH ELECTRONICALLY ADJUSTABLE LIGHT BEAM DISTRIBUTION

(71) Applicants: Michael Quilici, Essex, MA (US); Seung Cheol Ryu, Marblehead, MA (US); Lori Brock, Ipswich, MA (US)

(72) Inventors: Michael Quilici, Essex, MA (US); Seung Cheol Ryu, Marblehead, MA (US); Lori Brock, Ipswich, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 692 days.

(21) Appl. No.: 14/531,488

(22) Filed: Nov. 3, 2014

(65) Prior Publication Data

US 2016/0123564 A1 May 5, 2016

(51) Int. Cl.
*F21V 23/00* (2015.01)
*F21V 29/00* (2015.01)
(Continued)

(52) U.S. Cl.
CPC ..... *F21V 23/003* (2013.01); *F21S 8/026* (2013.01); *F21S 8/04* (2013.01); *F21S 10/023* (2013.01);
(Continued)

(58) Field of Classification Search
CPC .... F21V 23/003; F21V 23/0435; F21V 29/70; F21V 15/01; F21S 8/026; F21S 8/04;
(Continued)

(56) References Cited

U.S. PATENT DOCUMENTS

2010/0046226 A1 2/2010 Cox et al.
2011/0051420 A1 3/2011 Gill
(Continued)

FOREIGN PATENT DOCUMENTS

KR 20090000762 1/2009
WO 2007125520 A1 11/2007

OTHER PUBLICATIONS

Prouteau, Evelyne, International Search Report and Written Opinion of the International Search Authority for PCT/US2015/058537, dated Jan. 11, 2016, European Patent Office, Rijswijk, The Netherlands (12 pages).

*Primary Examiner* — Thomas M Sember
(74) *Attorney, Agent, or Firm* — Yutian Ling

(57) ABSTRACT

A luminaire having an electronically adjustable light beam distribution is disclosed. In accordance with some embodiments, the disclosed luminaire includes a housing, for example, of hemi-cylindrical, oblate hemi-cylindrical, oblong elliptical, or polyhedral shape. The disclosed luminaire also includes a plurality of solid-state light sources arranged over its housing, in accordance with some embodiments. The one or more solid-state emitters of a given solid-state light source may be addressable individually and/or in one or more groupings, in some embodiments. As such, the solid-state light sources can be electronically controlled individually and/or in conjunction with one another, providing for highly adjustable light emissions from the host luminaire, in accordance with some embodiments. One or more heat sinks may be mounted on the housing to assist with heat dissipation for the solid-state light sources. The luminaire can be configured, for example, to be mounted or as a free-standing lighting device, as desired.

23 Claims, 11 Drawing Sheets

(51) Int. Cl.

| | |
|---|---|
| ***F21V 29/70*** | (2015.01) |
| ***F21V 15/01*** | (2006.01) |
| ***F21S 8/02*** | (2006.01) |
| ***F21S 8/04*** | (2006.01) |
| ***F21V 23/04*** | (2006.01) |
| ***F21S 10/02*** | (2006.01) |
| ***H05B 33/08*** | (2006.01) |
| ***H05B 37/02*** | (2006.01) |
| *F21W 131/406* | (2006.01) |
| *F21Y 115/10* | (2016.01) |
| *F21Y 107/00* | (2016.01) |

(52) U.S. Cl.
CPC ..... *F21V 15/01* (2013.01); *F21V 23/0435* (2013.01); *F21V 29/70* (2015.01); *H05B 33/0803* (2013.01); *H05B 33/0857* (2013.01); *H05B 37/0245* (2013.01); *F21W 2131/406* (2013.01); *F21Y 2107/00* (2016.08); *F21Y 2115/10* (2016.08)

(58) Field of Classification Search
CPC ..... F21S 10/023; H05B 33/0803; H05B 33/0857; H05B 37/0245
See application file for complete search history.

(56) References Cited

U.S. PATENT DOCUMENTS

| | | | | |
|---|---|---|---|---|
| 2011/0113640 | A1 | 5/2011 | Markle et al. | |
| 2012/0206918 | A1 | 8/2012 | Lee et al. | |
| 2012/0218751 | A1* | 8/2012 | Bacon | F21S 8/086 362/235 |
| 2013/0093354 | A1* | 4/2013 | Jiang | F21K 9/135 315/294 |
| 2014/0268733 | A1* | 9/2014 | Holland | F21V 21/096 362/231 |

* cited by examiner

SOLID-STATE LUMINAIRE WITH ELECTRONICALLY ADJUSTABLE LIGHT BEAM DISTRIBUTION

CROSS-REFERENCE TO RELATED APPLICATIONS

This Application is related to: U.S. Non-Provisional patent application Ser. No. 14/032,821, titled "Solid-State Luminaire with Electronically Adjustable Light Beam Distribution," filed on Sep. 20, 2013; U.S. Non-Provisional patent application Ser. No. 14/032,856, titled "Solid-State Luminaire with Pixelated Control of Light Beam Distribution," filed on Sep. 20, 2013; U.S. Non-Provisional patent application Ser. No. 14/221,589, titled "Techniques and Graphical User Interface for Controlling Solid-State Luminaire with Electronically Adjustable Light Beam Distribution," filed on Mar. 21, 2014; U.S. Non-Provisional patent application Ser. No. 14/221,638, titled "Techniques and Photographical User Interface for Controlling Solid-State Luminaire with Electronically Adjustable Light Beam Distribution," filed on Mar. 21, 2014; U.S. Non-Provisional patent application Ser. No. 14/531,427, titled "Solid-State Lamps with Electronically Adjustable Light Beam Distribution," filed on Nov. 3, 2014; and U.S. Non-Provisional patent application Ser. No. 14/531,375, titled "Lighting Techniques Utilizing Solid-State Lamps with Electronically Adjustable Light Beam Distribution," filed on Nov. 3, 2014. Each of these patent applications is herein incorporated by reference in its entirety.

FIELD OF THE DISCLOSURE

The present disclosure relates to solid-state lighting (SSL) fixtures and more particularly to light-emitting diode (LED)-based luminaires.

BACKGROUND

Traditional adjustable lighting fixtures, such as those utilized in theatrical lighting, employ mechanically adjustable lenses, track heads, gimbal mounts, and other mechanical parts to adjust the angle and direction of the light output thereof. For adjusting light distribution, these existing lighting designs rely upon mechanical movements provided using actuators, motors, or other movable components manipulated by a lighting technician or other user.

Figure 1A:
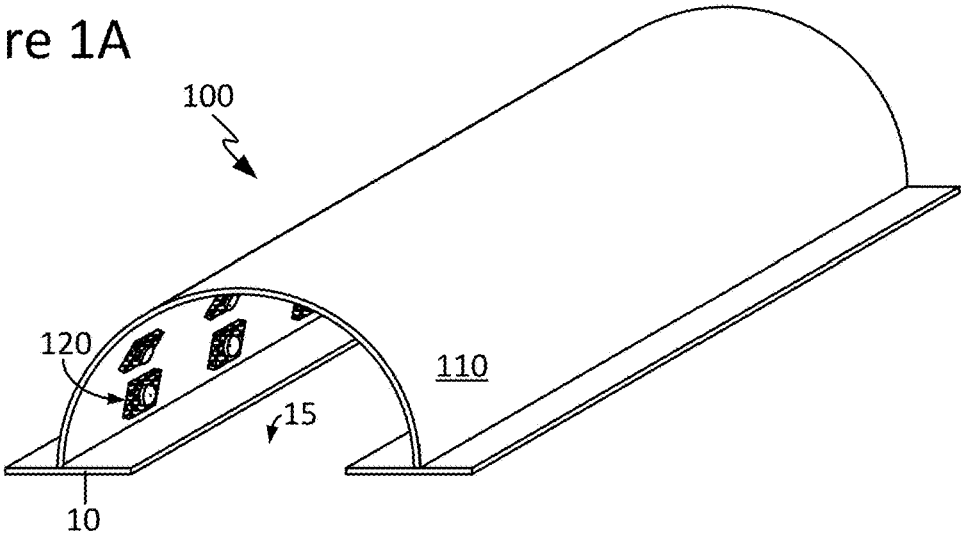
FIG. 1A is a perspective view of a luminaire configured in accordance with an embodiment of the present disclosure.

These and other features of the present embodiments will be understood better by reading the following detailed description, taken together with the figures herein described.

The accompanying drawings are not intended to be drawn to scale. In the drawings, each identical or nearly identical component that is illustrated in various figures may be represented by a like numeral. For purposes of clarity, not every component may be labeled in every drawing.

DETAILED DESCRIPTION

A luminaire having an electronically adjustable light beam distribution is disclosed. In accordance with some embodiments, the disclosed luminaire includes a housing, for example, of hemi-cylindrical, oblate hemi-cylindrical, oblong elliptical, or polyhedral shape. The disclosed luminaire also includes a plurality of solid-state light sources arranged over its housing, in accordance with some embodiments. In some embodiments, the plurality of solid-state light sources are arranged over one or more exterior surfaces of the housing, whereas in some other embodiments, the plurality of solid-state light sources are arranged over one or more interior surfaces of the housing. A given solid-state light source may include one or more solid-state emitters that are addressable individually and/or in one or more groupings, in accordance with some embodiments. As such, the solid-state light sources can be electronically controlled individually and/or in conjunction with one another, providing for highly adjustable light emissions from the host luminaire, in accordance with some embodiments. One or more heat sinks optionally may be mounted on the housing to assist with heat dissipation for the solid-state light sources. In some embodiments, the luminaire may be configured, for example, to be mounted on, suspended from, or extended from a surface such as a drop ceiling tile or wall, among others. In some other embodiments, the luminaire may be configured, for example, as a free-standing lighting device, such as a desk lamp or torchière lamp, among others. Numerous configurations and variations will be apparent in light of this disclosure.

General Overview

Existing linear solid-state lighting fixtures normally have fixed light beam distributions that are determined by their optical construction. As such, these fixtures do not allow a user to adjust the light distribution without physically modifying, moving, or replacing the fixture. Given these limitations of existing designs, there is typically a need for use of a group of specific lighting fixtures with specific candlepower distributions in order to fill a given space. For instance, in the example context of retail lighting, existing lighting designs utilize a series of individual solid-state lamps that must be physically aimed individually in order to illuminate displayed products. Also, these lighting designs are generally high in cost given the complexity of the mechanical equipment required to provide the desired degree of adjustability. Furthermore, there is a safety concern associated with the need to manually adjust, repair, and replace components of these types of systems, particularly in areas which are normally out-of-reach without the use of a ladder, scaffolding, or aerial work platform, for example.

Thus, and in accordance with an embodiment of the present disclosure, a luminaire having an electronically adjustable light beam distribution is disclosed. In accordance with some embodiments, the disclosed luminaire includes a housing, for example, of hemi-cylindrical, oblate hemi-cylindrical, oblong elliptical, or polyhedral shape. The disclosed luminaire also includes a plurality of solid-state light sources arranged over its housing, in accordance with some embodiments. In some embodiments, the plurality of solid-state light sources are arranged over one or more exterior surfaces of the housing, whereas in some other embodiments, plurality of solid-state light sources are arranged over one or more interior surfaces of the housing. A given solid-state light source may include one or more solid-state emitters that are addressable individually and/or in one or more groupings, in accordance with some embodiments. As such, the solid-state light sources can be electronically controlled individually and/or in conjunction with one another, providing for highly adjustable light emissions from the host luminaire, in accordance with some embodiments. One or more heat sinks optionally may be mounted on the housing to assist with heat dissipation for the solid-state light sources. In some embodiments, the luminaire may be configured, for example, to be mounted on, suspended from, or extended from a surface such as a drop ceiling tile or wall, among others. In some other embodiments, the luminaire may be configured, for example, as a free-standing lighting device, such as a desk lamp or torchière lamp, among others. As will be appreciated in light of this disclosure, such a design may allow for great flexibility with respect to lighting direction and angular distribution in a relatively compact lighting fixture.

In accordance with some embodiments, the disclosed luminaire can be communicatively coupled with one or more controllers and driver circuitry that can be used to electronically control the output of the solid-state emitters individually and/or in conjunction with one another (e.g., as an array/grouping or partial array/grouping), thereby electronically controlling the output of the luminaire as a whole. In some such cases, a luminaire controller configured as described herein may provide for electronic adjustment, for example, of the beam direction, beam angle, beam distribution, and/or beam diameter for each solid-state light source (or some sub-set of the available solid-state light sources), thereby allowing for customizing the beam spot size, position, and/or angular distribution of light on a given surface of incidence. In some cases, the disclosed luminaire controller may provide for electronic adjustment, for example, of the brightness (dimming) and/or color of light, thereby allowing for dimming and/or color mixing/tuning, as desired. In accordance with some embodiments, the plurality of pre-positioned, solid-state emitters of a luminaire configured as described herein may be controlled individually to manipulate beam angle and distribution, for example, without the need for mechanically moving parts and physical access to the luminaire. In a more general sense, and in accordance with an embodiment, the properties of the light output of a luminaire configured as described herein may be adjusted electronically without need for mechanical movements, contrary to existing lighting systems. Also, as discussed herein, control of the emission of the disclosed luminaire may be provided, in accordance with some embodiments, using any of a wide range of wired and/or wireless control interfaces, such as a switch array, a touch-sensitive surface or device, and/or a computer vision system (e.g., that is gesture-sensitive, activity-sensitive, and/or motion-sensitive, for example), to name a few. In some instances, a given control interface may be configured to allow a user to quickly and easily reconfigure the light distribution in a given space, as desired.

In accordance with some embodiments, the disclosed luminaire can be configured as a recessed light, a pendant light, a sconce, or the like which may be mounted on or suspended from, for example, a ceiling, wall, floor, step, or other suitable surface, as will be apparent in light of this disclosure. In some other embodiments, the disclosed luminaire can be configured as a free-standing lighting device, such as a desk lamp or torchière lamp. In some other embodiments, a luminaire configured as described herein may be mounted, for example, on a drop ceiling tile (e.g., 2 ft.×2 ft., 2 ft.×4 ft., 4 ft.×4 ft., or larger) for installment in a drop ceiling grid. In some still other embodiments, a luminaire configured as described herein may be embedded, in part or in whole, into a given mounting surface (e.g., plastered into a ceiling, wall, or other structure). In some such cases, a seamless exterior appearance between the luminaire and the mounting surface may be provided (e.g., such that only an aperture through which the light passes may be visible). Some embodiments may be configured, for example, to provide an electronically tunable light beam distribution without need for mechanical movement and in a generally linear form factor. Numerous other suitable configurations will be apparent in light of this disclosure.

As will be appreciated in light of this disclosure, a luminaire configured as described herein may provide for flexible and easily adaptable lighting, capable of accommodating any of a wide range of lighting applications and contexts, in accordance with some embodiments. For example, some embodiments may provide for downlighting adaptable to small and large area tasks (e.g., high intensity with adjustable distribution and directional beams). Some embodiments may provide for accent lighting or area lighting of any of a wide variety of distributions (e.g., narrow, wide, asymmetric/tilted, Gaussian, batwing, or other specifically shaped light beam distribution). By turning on/off and/or dimming the intensity of various combinations of solid-state emitters of the luminaire, the light beam output may be adjusted, for instance, to produce uniform illumination on a given surface, to fill a given space with light, or to generate any desired area lighting distributions. Some embodiments can be used, for example, in a retail lighting applications and contexts. Some embodiments may provide for simplified light output aiming and/or commissioning, as compared to existing designs and approaches. Numerous other suitable uses and applications will be apparent in light of this disclosure.

As will be further appreciated in light of this disclosure, a luminaire configured as described herein may be considered, in a general sense, a robust, intelligent, multi-purpose lighting platform capable of producing a highly adjustable light output without requiring mechanical movement of luminaire componentry. Some embodiments may provide for a greater level of light beam adjustability, for example, as compared to traditional lighting designs utilizing larger moving mechanical parts. Some embodiments may realize a reduction in cost, for example, as a result of the use of longer-lifespan solid-state devices and reduced installation, operation, and other labor costs. Furthermore, the scalability and orientation of a luminaire configured as described herein may be varied, in accordance with some embodiments, to adapt to a specific lighting context or application (e.g., downward-facing, such as a drop ceiling lighting fixture, pendant lighting fixture, a desk light, etc.; upward-facing, such as indirect lighting aimed at a ceiling). In some instances, a luminaire provided using the disclosed techniques can be configured, for example, as: (1) a partially/completely assembled luminaire unit; and/or (2) a kit or other collection of discrete components (e.g., housing, solid-state light sources, heat sinks, etc.) which may be operatively coupled, as desired.

System Architecture and Operation

Figure 1B:
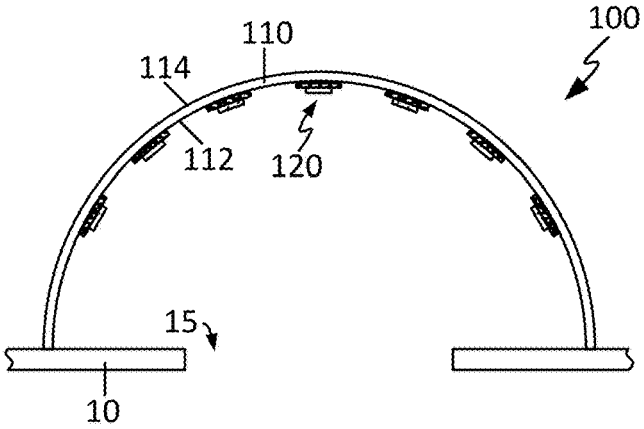
FIG. 1B is a cross-sectional view of the luminaire of FIG. 1A.
Figure 1C:
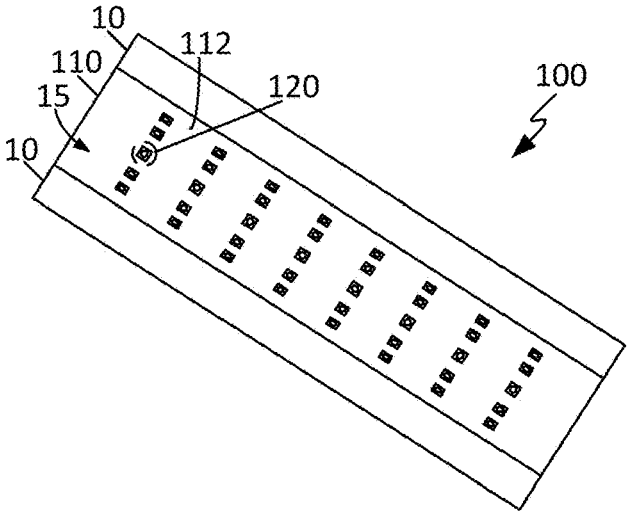
FIG. 1C is a bottom-up view of the luminaire of FIG. 1A.

FIGS. 1A-1C illustrate a luminaire 100 configured in accordance with an embodiment of the present disclosure. As can be seen, luminaire 100 includes a housing 110. The shape of housing 110 can be customized, as desired for a given target application or end-use, and in some cases may be selected, in part or in whole, based on a given desired amount of overlap for the light beams emitted by luminaire 100. In some embodiments, housing 110 may be configured with a non-planar interior surface 112 and/or a non-planar exterior surface 114 of generally smooth contour. In some other embodiments, housing 110 may be configured with a non-planar interior surface 112 and/or a non-planar exterior surface 114 of generally non-smooth contour (e.g., faceted, angled, or otherwise geometric). In some embodiments, housing 110 may be configured, for example, with a hemi-cylindrical geometry (e.g., like that shown in FIGS. 1A-1C), an oblate hemi-cylindrical geometry, an oblong elliptical geometry, or any other desired curvilinear geometry, as desired for a given target application or end-use.

Figure 2A:
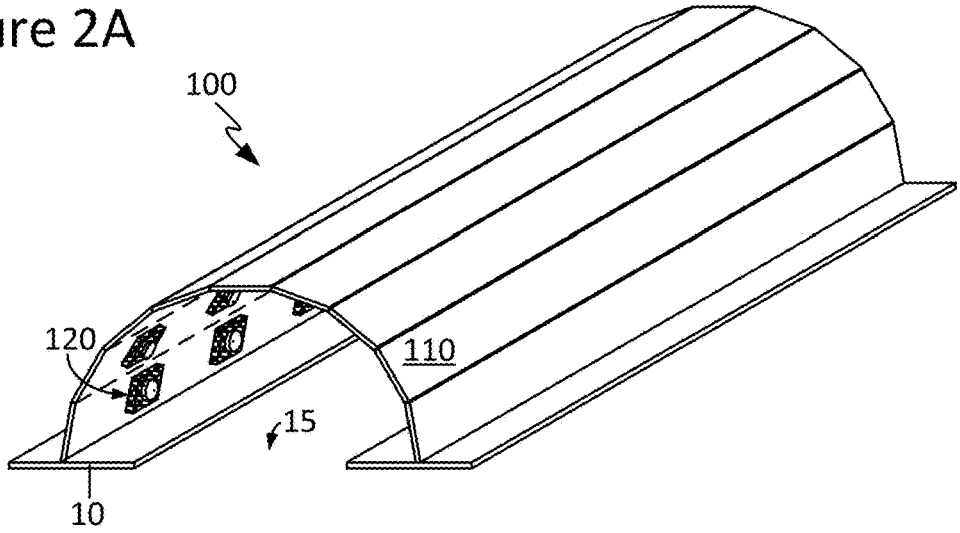
FIG. 2A is a perspective view of a luminaire configured in accordance with another embodiment of the present disclosure.
Figure 2B:
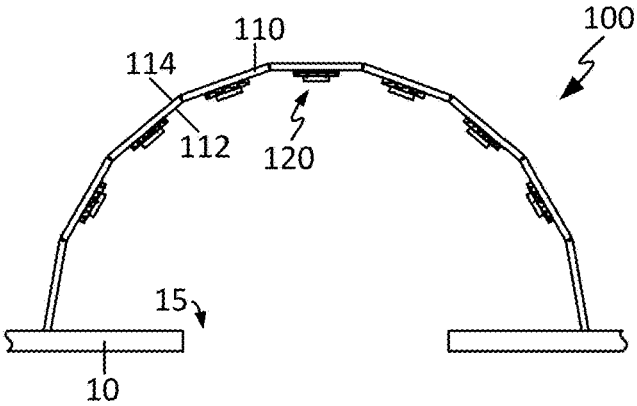
FIG. 2B is a cross-sectional view of the luminaire of FIG. 2A.
Figure 2C:
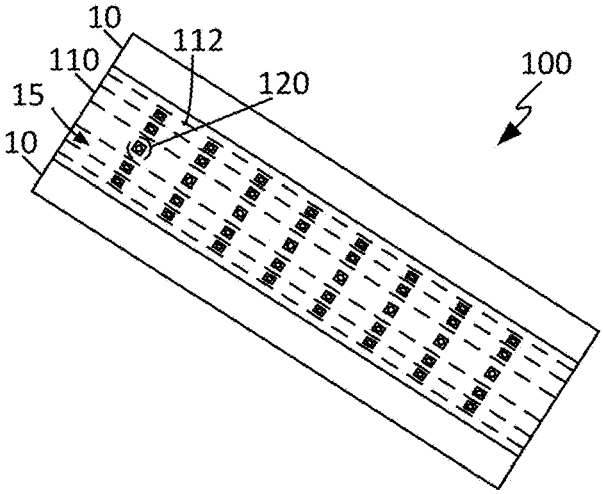
FIG. 2C is a bottom-up view of the luminaire of FIG. 2A.
Figure 3A:
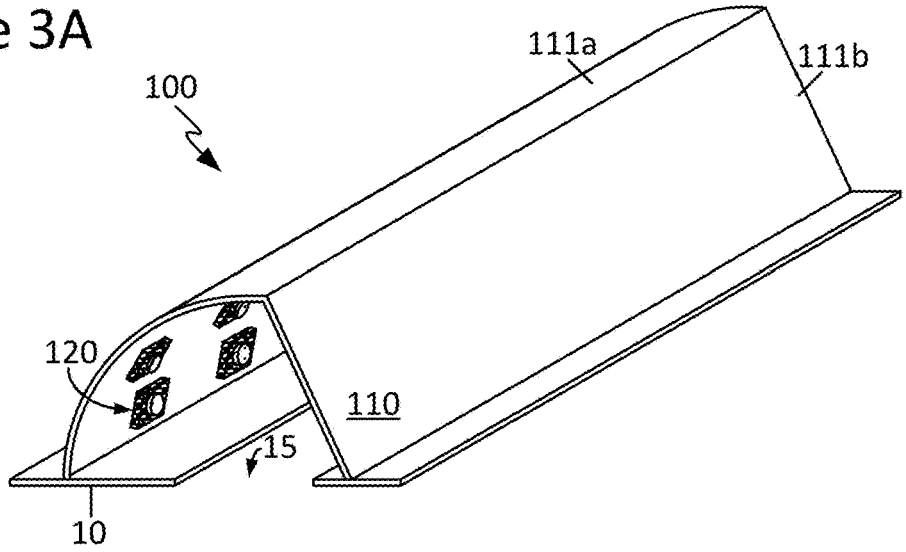
FIG. 3A is a perspective view of a luminaire configured in accordance with another embodiment of the present disclosure.
Figure 3B:
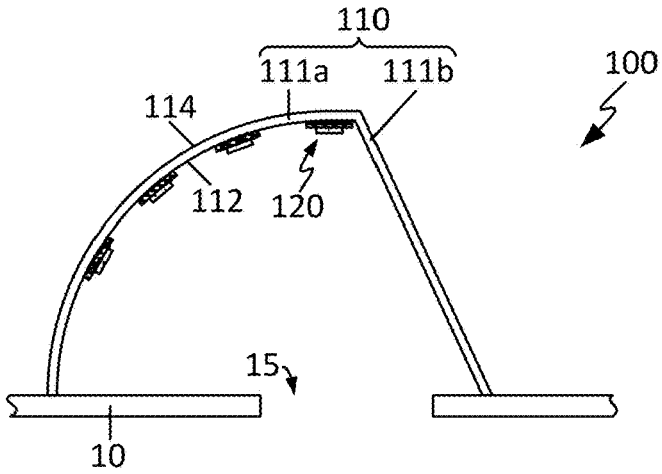
FIG. 3B is a cross-sectional view of the luminaire of FIG. 3A.
Figure 3C:
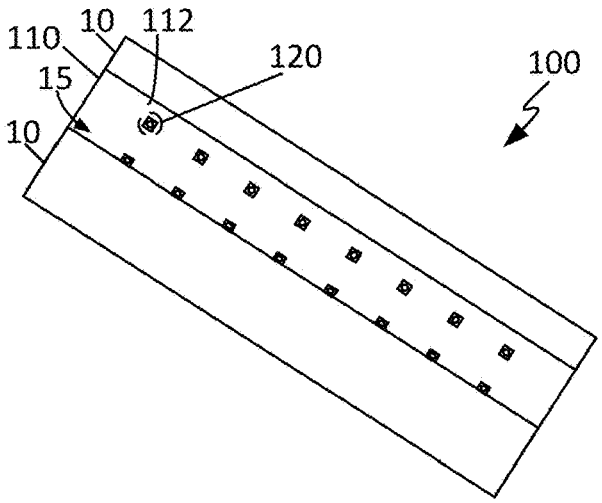
FIG. 3C is a bottom-up view of the luminaire of FIG. 3A.
Figure 4A:
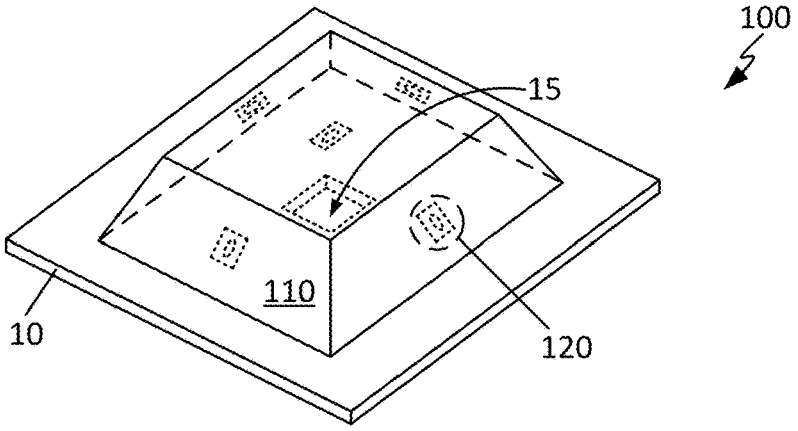
FIG. 4A is a perspective view of a luminaire configured in accordance with another embodiment of the present disclosure.
Figure 4B:
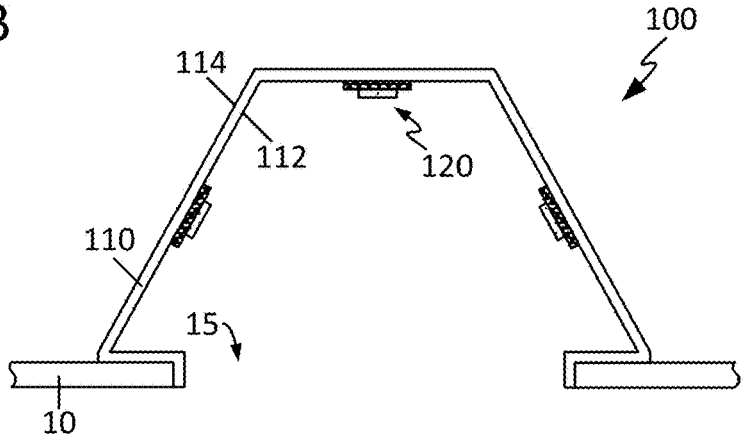
FIG. 4B is a cross-sectional view of the luminaire of FIG. 4A.
Figure 4C:
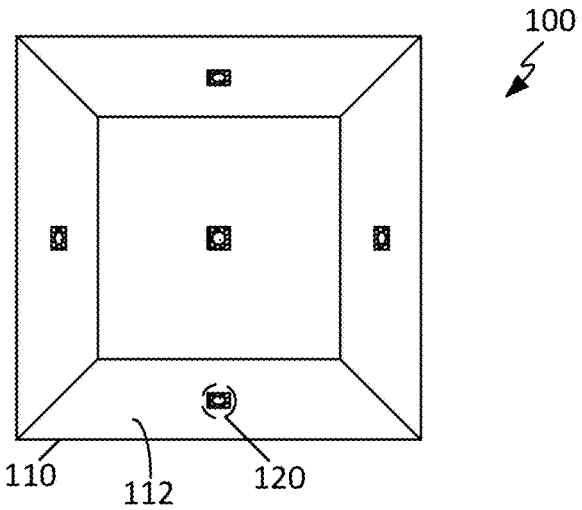
FIG. 4C is a bottom-up view of the luminaire of FIG. 4A.

It should be noted, however, that the present disclosure is not so limited. For example, consider FIGS. 2A-2C, which illustrate a luminaire 100 configured in accordance with another embodiment of the present disclosure. As can be seen here, in some cases, housing 110 may be multi-faceted, and in some instances may be articulated (e.g., with one or more joints or other points of defined flexing). Also, consider FIGS. 3A-3C, which illustrate a luminaire 100 configured in accordance with another embodiment of the present disclosure. As can be seen here, in some cases, housing 110 may include a non-planar (e.g., curvilinear) portion 111*a* and a planar portion 111*b*. Furthermore, consider FIGS. 4A-4C, which illustrate a luminaire 100 configured in accordance with another embodiment of the present disclosure. As can be seen here, in some cases, housing 110 may be configured with a polyhedral (e.g., Platonic solid-type) geometry having planar faces/sides of triangular, rectangular, or trapezoidal geometry, among others. Numerous configurations for housing 110 will be apparent in light of this disclosure.

The dimensions of housing 110 can be customized, as desired for a given target application or end-use. In some cases, housing 110 may have a length of about 24 inches±12 inches. In some other cases, housing 110 may have a length of about 36 inches±12 inches. In some still other cases, housing 110 may have a length of about 48 inches±12 inches. In some instances, housing 110 may have a width/diameter in the range of about 6-18 inches (e.g., about 6-12 inches, about 12-18 inches, or any other sub-range in the range of about 6-18 inches). In some other instances, housing 110 may have a width/diameter greater than about 18 inches. In some cases, housing 110 may have a radius of about 6 inches±2 inches. In some other cases, housing 110 may have a radius of about 12 inches±6 inches. In some instances, the dimensions of housing 110 may be varied, for example, to be commensurate with the particular mounting surface 10 on which it is to be mounted or other space which it is to occupy (e.g., mounted on a drop ceiling tile; suspended from a ceiling or other overhead structure; extending from a wall, floor, or step; embedded, in part or in whole, in a ceiling, wall, or other surface; configured as a free-standing or otherwise portable lighting device). In some instances, the dimensions of housing 110 may be selected, in part or in whole, based on the dimensions of the aperture 15 (discussed below) through which the emissions of luminaire 100 are to pass. Other suitable sizes for housing 110 will depend on a given application and will be apparent in light of this disclosure.

In accordance with some embodiments, housing 110 may be constructed to house/support the one or more solid-state light sources 120 (discussed below) of luminaire 100, as well as to conduct thermal energy away from those solid-state light source(s) 120 to the ambient environment. To such ends, housing 110 may be constructed, in part or in whole, from any of a wide range of materials, such as, for example: (1) aluminum (Al); (2) copper (Cu); (3) brass; (4) steel; (5) a composite and/or polymer (e.g., ceramics, plastics, etc.) doped with thermally conductive material; and/or (6) a combination of any one or more thereof. In some embodiments, housing 110 may be formed from a sheet metal. In some other embodiments, housing 110 may be formed from a cast metal. Other suitable materials from which housing 110 may be constructed will depend on a given application and will be apparent in light of this disclosure.

Figure 5A:
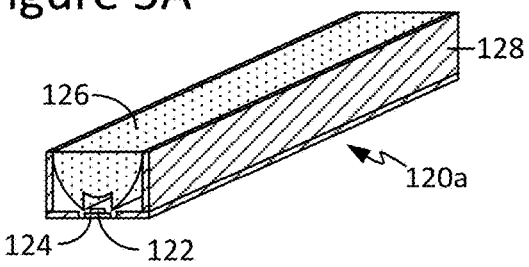
FIG. 5A is a perspective view of a solid-state light source configured in accordance with an embodiment of the present disclosure.
Figure 5B:
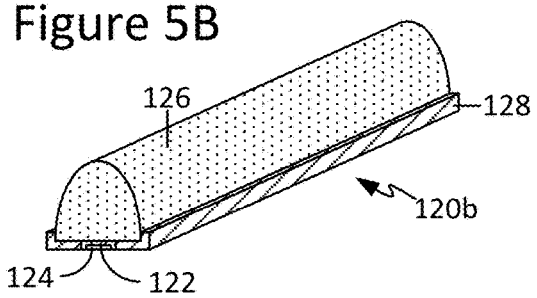
FIG. 5B is a perspective view of a solid-state light source configured in accordance with another embodiment of the present disclosure.

As can further be seen from the figures, luminaire 100 includes one or more solid-state light sources 120, in accordance with some embodiments. For example, consider FIG. 5A, which is a perspective view of a solid-state light source 120*a* configured in accordance with an embodiment of the present disclosure. Also, consider FIG. 5B, which is a perspective view of a solid-state light source 120*b* configured in accordance with another embodiment of the present disclosure. For consistency and ease of understanding of the present disclosure, solid-state light sources 120*a* and 120*b* hereinafter may be collectively referred to generally as a solid-state light source 120, except where separately referenced. As can be seen, a given solid-state light source 120 may be configured, in accordance with some embodiments, as a substantially linear (e.g., precisely linear or otherwise within a given tolerance) strip of solid-state emitters 122 optically coupled with one or more optics 126 (discussed below). In some other embodiments, however, a given solid-state light source 120 may be a substantially non-linear (e.g., curvilinear) strip of solid-state emitters 122 optically coupled with one or more optics 122. In some still other embodiments, a given solid-state light source 120 may be configured as a single solid-state emitter 122 optically coupled with one or more optics 126. Numerous configurations for a given solid-state light source 120 will be apparent in light of this disclosure.

In accordance with some embodiments, a given solid-state emitter 122 may be any of a wide range of semiconductor light source devices, such as, for example: (1) a light-emitting diode (LED); (2) an organic light-emitting diode (OLED); (3) a polymer light-emitting diode (PLED); and/or (4) a combination of any one or more thereof. A given solid-state emitter 122 may be configured to emit electromagnetic radiation (e.g., light), for example, from the visible spectral band and/or other portions of the electromagnetic spectrum not limited to the infrared (IR) spectral band and/or the ultraviolet (UV) spectral band, as desired for a given target application or end-use. In some embodiments, a given solid-state emitter 122 may be configured for emissions of a single correlated color temperature (CCT) (e.g., a white light-emitting semiconductor light source). In some other embodiments, a given solid-state emitter 122 may be configured for color-tunable emissions. For instance, in some cases, a given solid-state emitter 122 may be a multi-color (e.g., bi-color, tri-color, etc.) semiconductor light source configured for a combination of emissions, such as: (1) red-green-blue (RGB); (2) red-green-blue-yellow (RGBY); (3) red-green-blue-white (RGBW); (4) dual-white (WW); and/or (5) a combination of any one or more thereof. In some cases, a given solid-state emitter 122 may be configured, for example, as a high-brightness semiconductor light source. In some embodiments, a given solid-state emitter 122 of luminaire 100 may be provided with a combination of any one or more of the aforementioned example emissions capabilities. Also, a given solid-state emitter 122 may be configured to be individually addressable and/or addressable in one or more groupings, in accordance with some embodiments. Other suitable configurations for the one or more solid-state emitters 122 of a given solid-state light source 120 will depend on a given application and will be apparent in light of this disclosure.

The one or more solid-state emitters 122 of a given solid-state light source 120 can be packaged or non-packaged, as desired, and in some cases may be populated on a printed circuit board (PCB) 124 or other suitable intermediate/substrate (e.g., such as a substrate 130, discussed below). In some embodiments, all (or some sub-set) of the solid-state emitters 122 of a given solid-state light source 120 may have their own associated PCBs 124. In some such cases, all (or some sub-set) of those PCBs 124 may be interconnected with one another, for example, via interconnecting wires or any other suitable interconnection techniques, as will be apparent in light of this disclosure. In some embodiments, all (or some sub-set) of the solid-state emitters 122 of a given solid-state light source 120 may share a single PCB 124. In some such cases, the shared PCB 124 may be folded, faceted, articulated, flexible, or otherwise configured to substantially conform (e.g., precisely conform or otherwise confirm within a given tolerance) to a given contour. Also, as will be appreciated in light of this disclosure, a given PCB 124 may include other componentry (e.g., resistors, transistors, integrated circuits, etc.) populated thereon in addition to one or more solid-state emitters 122, in accordance with some embodiments. In some cases, power and/or control connections for a given solid-state emitter 122 may be routed from a given PCB 124 to a driver 140 (discussed below) and/or other devices/componentry, as desired. Other suitable configurations for the one or more PCBs 124 of a given solid-state light source 120 will depend on a given application and will be apparent in light of this disclosure.

Figure 6A:
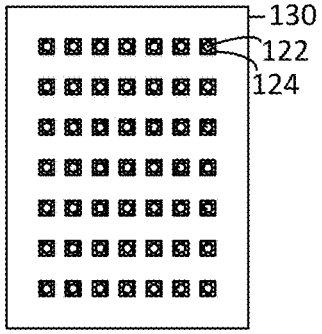
FIGS. 6A and 6B are front and end views, respectively, of a substrate configured in accordance with an embodiment of the present disclosure.
Figure 7A:
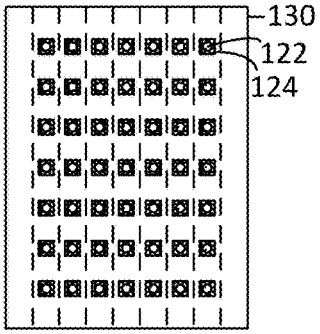
FIGS. 7A and 7B are front and end views, respectively, of a substrate configured in accordance with another embodiment of the present disclosure.
Figure 6B:
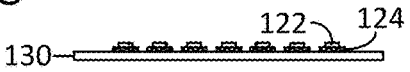
Figure 7B:
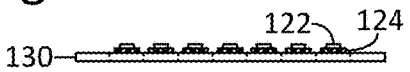
Figure 8A:
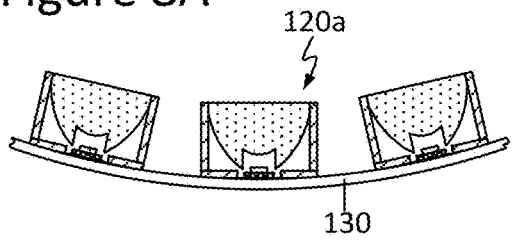
FIG. 8A is a partial end view of an example arrangement of solid-state light sources disposed over a substrate, in accordance with an embodiment of the present disclosure.
Figure 8B:
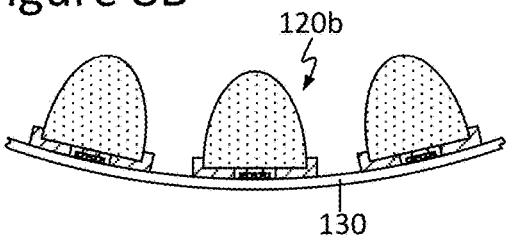
FIG. 8B is a partial end view of an example arrangement of solid-state light sources disposed over a substrate, in accordance with another embodiment of the present disclosure.

In some cases, the solid-state emitter(s) 122 of a given solid-state light source 120 may be disposed over a substrate 130 that is configured, for example, to conform to a given surface (e.g., interior surface 112; exterior surface 114) of housing 110 of luminaire 100. For example, consider FIGS. 6A and 6B, which illustrate front and end views, respectively, of a substrate 130 configured in accordance with an embodiment of the present disclosure. Also, consider FIGS. 7A and 7B, which illustrate front and end views, respectively, of a substrate 130 configured in accordance with another embodiment of the present disclosure. As can be seen from these figures, substrate 130 may have one or more solid-state emitters 122 and one or more PCBs 124 formed thereon. It should be noted that, for purposes of clarity and ease of understanding of the present disclosure, any optic(s) 126 associated with the solid-state emitters 122 have been graphically omitted from FIGS. 6A-6B and FIGS. 7A-7B. As such, consider also FIG. 8A and FIG. 8B, which are partial end views of several example arrangements of solid-state light sources 120*a* and 120*b*, respectively, over a substrate 130, in accordance with some embodiments of the present disclosure. In some embodiments, such as that generally depicted in FIGS. 6A-6B, substrate 130 may be formed as a continuous sheet configured to be flexed or otherwise shaped to the contour of housing 110 (e.g., the contour of interior surface 112; the contour of exterior surface 114). In some other embodiments, such as that generally depicted in FIGS. 7A-7B, substrate 130 may be formed as an articulated sheet (e.g., with one or more joints or other points of defined flexing) configured to be bent or otherwise shaped to the contour of housing 110 (e.g., the contour of interior surface 112; the contour of exterior surface 114). In accordance with some embodiments, substrate 130 may be configured to substantially conform (e.g., precisely conform or otherwise conform within a given tolerance) to the contour of a housing 110 of a luminaire 100 configured, for example, like any of those depicted in any of FIGS. 1A-1C, FIGS. 2A-2C, FIGS. 3A-3C, and/or FIGS. 4A-4C, among others. Numerous configurations for substrate 130 will be apparent in light of this disclosure.

Substrate 130 may be constructed, in part or in whole, from any of a wide range of materials, such as, for example: (1) aluminum (Al); (2) copper (Cu); (3) brass; (4) steel; (5) a thermoplastic polymer, such as poly(ethylene terephthalate) (PETE); (6) a composite and/or polymer (e.g., ceramics, plastics, etc.) doped with thermally conductive material; and/or (7) a combination of any one or more thereof. In some cases, substrate 130 may be formed, in part or in whole, from a flexible material that can be manipulated (e.g., mechanically bent; thermoformed; etc.) into a given shape, as desired for a given target application or end-use. In some instances, substrate 130 may be formed, in part or in whole, from a thermally conductive material. In some cases, substrate 130 may be formed from a sheet metal. In some instances, substrate 130 may be formed from a cast metal. Other suitable materials from which substrate 130 may be formed will depend on a given application and will be apparent in light of this disclosure.

In some embodiments, interconnecting circuitry and other electronic componentry/devices associated with solid-state light source(s) 120 may be printed or otherwise formed on substrate 130. In some embodiments, interconnecting circuitry and other electronic componentry/devices associated with solid-state light source(s) 120 may be integrated into or otherwise formed within substrate 130. In some instances, substrate 130 may be physically and/or thermally coupled with one or more heat sinks 121 (discussed below) of luminaire 100, in accordance with some embodiments.

Figure 9:
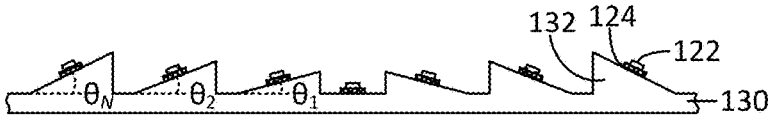
FIG. 9 is an end view of an example arrangement of solid-state emitters and printed circuit boards (PCBs) disposed over a substrate including a plurality of pre-positioning portions, in accordance with an embodiment of the present disclosure.

In some embodiments, substrate 130 may include one or more pre-positioning portions 132 configured, for example, to facilitate directional aiming of a given solid-state emitter 122 mounted there over. For example, consider FIG. 9, which illustrates an example arrangement of solid-state emitters 122 and PCBs 124 mounted over a substrate 130 including a plurality of pre-positioning portions 132, in accordance with an embodiment of the present disclosure. In some cases, such as that depicted in FIG. 9, substrate 130 and its optional one or more pre-positioning portions 132 may be formed from a single (e.g., monolithic) piece of material to provide a single, continuous component. In some other cases, however, substrate 130 and its optional one or more pre-positioning portions 132 may be separate elements that are assembled with one another; that is, a given pre-positioning portion 132 and substrate 130 may be attached to or otherwise assembled with one another, in a temporary or permanent manner, via any suitable means (e.g., a fastener; an adhesive; etc.). In accordance with some embodiments, a substrate 130 optionally provided with one or more pre-positioning portions 132 may be configured to be mounted over (e.g., physically and/or thermally coupled with) interior surface 112 and/or exterior surface 114 of housing 110, as desired. As will be appreciated in light of this disclosure, a given pre-positioning portion 132 may be constructed, in part or in whole, from any of the example materials discussed above, for instance, with respect to housing 110 and/or substrate 130.

In accordance with some embodiments, the optional pre-positioning portion(s) 132 of substrate 130 may serve to physically tilt the solid-state emitter(s) 122 with respect to an underlying surface (e.g., interior surface 112; exterior surface 114) of housing 110 such that the resulting light beams have a minimal, maximal, or any other desired amount of overlap. To that end, a given optional pre-positioning portion 132 may be provided with any desired surface topography (e.g., stepped, curved, faceted, etc.) and may be oriented at any desired tilt angle ($\theta$) to provide an incline or decline, for example, with respect to a given surface of substrate 130. In some instances, all or some sub-set of a plurality of pre-positioning portions 132 of substrate 130 may have a common/shared tilt angle (e.g., $\theta_1=\theta_2$, etc.). In some other instances, all or some sub-set of a plurality of pre-positioning portions 132 of substrate 130 may have different tilt angles (e.g., $\theta_1\neq\theta_2$, etc.). In some embodiments, a converging arrangement of pre-positioning portions 132 may be provided, for example, to direct the solid-state emitter(s) 122 of a given solid-state light source 120 inward (e.g., in a converging manner). In some other embodiments, such as that depicted in FIG. 9, a diverging arrangement of pre-positioning portions 132 may be provided, for example, to direct the solid-state emitter(s) 122 of a given solid-state light source 120 outward (e.g., in a diverging manner). In still some other cases, an offset (e.g., skewed or otherwise angled) arrangement of pre-positioning portions 132 may be provided, for example, to direct the solid-state emitter(s) 122 of a given solid-state light source 120 in a given shared direction (e.g., in a generally angled directional manner). In a more general sense, the quantity and configuration of pre-positioning portions 132, when optionally included with substrate 130, can be customized as desired for a given target application or end-use.

As previously noted, a given solid-state light source 120 may include one or more optics 126 optically coupled with its one or more solid-state emitters 122. In accordance with some embodiments, the optic(s) 126 of a given solid-state light source 120 may be configured to transmit the one or more wavelengths of interest of the light (e.g., visible, UV, IR, etc.) emitted by solid-state emitter(s) 122 optically coupled therewith. To that end, optic(s) 126 may include an optical structure (e.g., a window, lens, dome, etc.) formed from any of a wide range of optical materials, such as, for example: (1) a polymer, such as poly(methyl methacrylate) (PMMA) or polycarbonate; (2) a ceramic, such as sapphire ($Al_2O_3$) or yttrium aluminum garnet (YAG); (3) a glass; and/or (4) a combination of any one or more thereof. In some cases, the optic(s) 126 of a given solid-state light source 120 may be formed from a single (e.g., monolithic) piece of optical material to provide a single, continuous optical structure, such as an extruded or injection-molded window, lens, or dome, for example. In some other cases, the optic(s) 126 of a given solid-state light source 120 may be formed from multiple pieces of optical material to provide a multi-piece optical structure. In some cases, the optic(s) 126 of a given solid-state light source 120 may include optical features, such as, for example: (1) an anti-reflective (AR) coating; (2) a reflector; (3) a diffuser; (4) a polarizer; (5) a brightness enhancer; (6) a phosphor material (e.g., which converts light received thereby to light of a different wavelength); and/or (7) a combination of any one or more thereof. In some embodiments, the optic(s) 126 of a given solid-state light source 120 may be configured, for example, to focus and/or collimate light transmitted therethrough. In some embodiments, the optic(s) 126 of a given solid-state light source 120 may include one or more embedded and/or surficial optical structures (e.g., prismatic structures) configured to cause light beams exiting the optic(s) 126 to converge or diverge, as desired, along one or more directions of a host luminaire 100, such that the light beams produced thereby have a minimal, maximal, or other given degree of beam spot overlap. Other suitable types, optical transmission characteristics, and configurations for the optic(s) 126 of a given solid-state light source 120 will depend on a given application and will be apparent in light of this disclosure.

The size and geometry of the optic(s) 126 of a given solid-state light source 120 can be customized, as desired for a given target application or end-use. In some embodiments, the optic(s) 126 of a given solid-state light source 120 may be configured with a generally elongate profile. In some such cases, light transmitted therethrough may be focused and/or collimated, for instance, into generally elongated bar-shaped illumination patterns (e.g., such as those generally depicted in FIG. 17A, discussed below). In some embodiments, the optic(s) 126 of a given solid-state light source 120 may be configured to transmit light for a full width at half maximum (FWHM) distribution, for example, in the range of about 10-20° on one plane by about 120° on the other plane. In some cases, the optic(s) 126 of a given solid-state light source 120 may be configured, for example, to focus light output into a beam spot of about 10-20°. Numerous configurations will be apparent in light of this disclosure.

Figure 10A:
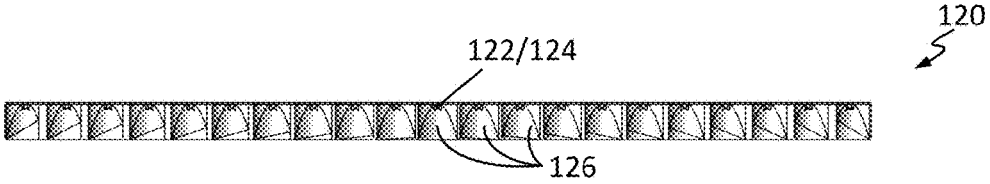
FIG. 10A is a cross-sectional view of a solid-state light source configured in accordance with an embodiment of the present disclosure.
Figure 10B:
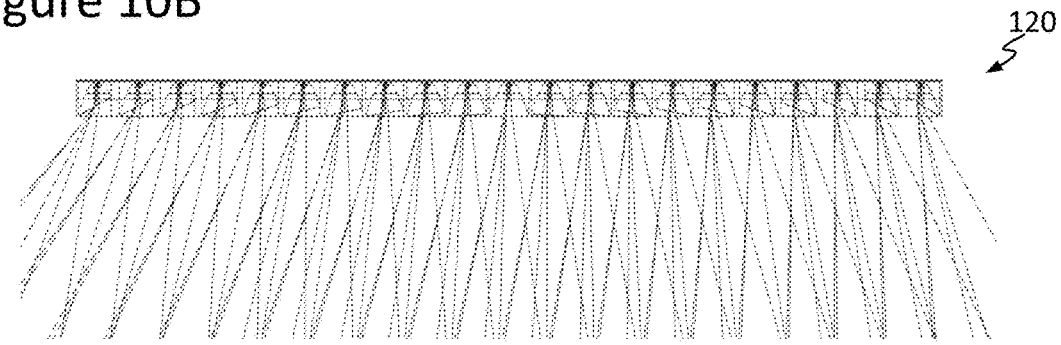
FIG. 10B is an example ray trace diagram of the solid-state light source of FIG. 10A.

In some embodiments, a given solid-state light source 120 may be configured such that all of its constituent solid-state emitters 122 share its optic(s) 126. In some other embodiments, however, a given solid-state light source 120 may be configured such that a first sub-set of its constituent solid-state emitters 122 shares a first sub-set of optic(s) 126, whereas a second sub-set of its constituent solid-state emitters 122 shares a second, different sub-set of optic(s) 126. In some embodiments, a given solid-state light source 120 may be configured such that each of its constituent solid-state emitters 122 is optically coupled with its own unique or otherwise dedicated optic(s) 126. For example, consider FIG. 10A, which is a cross-sectional view of a solid-state light source 120 configured in accordance with an embodiment of the present disclosure. As can be seen here, in some embodiments, all (or some sub-set) of the solid-state emitter(s) 122 of a given solid-state light source 120 may be configured with optic(s) 126 that cause its light output to diverge as it exits those optic(s) 126. To illustrate, consider FIG. 10B, which is an example ray trace diagram of the solid-state light source 120 of FIG. 10A. It should be noted, however, that the present disclosure is not so limited, as in some other embodiments, a given solid-state light source 120 may be configured with optic(s) 126 that cause the light output of all (or some sub-set) of its solid-state light emitter(s) 122 to converge as it exits those optic(s) 126.

Figure 11:
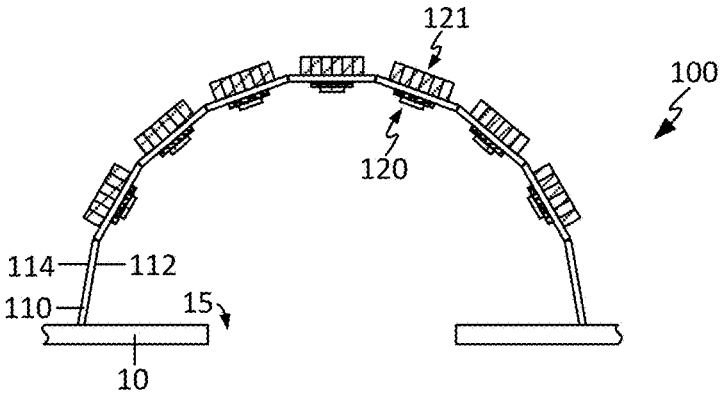
FIG. 11 is a cross-sectional view of a luminaire including a plurality of heat sinks configured in accordance with an embodiment of the present disclosure.

In some embodiments, luminaire 100 may include one or more heat sinks 121 configured to facilitate heat dissipation for its one or more solid-state light sources 120. For example, consider FIG. 11, which is a cross-sectional view of a luminaire 100 including a plurality of heat sinks 121 configured in accordance with an embodiment of the present disclosure. As can be seen here, in some embodiments in which luminaire 100 includes one or more solid-state light sources 120 arranged over an interior surface 112 of housing 110, one or more heat sinks 121 may be arranged, for example, over an exterior surface 114 of housing 110. Conversely, in some embodiments in which luminaire 100 includes one or more solid-state light sources 120 arranged over an exterior surface 114 of housing 110, one or more heat sinks 121 may be arranged, for example, over an interior surface 112 of housing 110. In any case, a given solid-state light source 120 and a given heat sink 121 may be physically and/or thermally coupled with one another, for example, through a sidewall portion of housing 110, in accordance with some embodiments. In some cases, a given solid-state light source 120 and a given heat sink 121 may be physically (and thus thermally) coupled with one another, for example, through an aperture formed in a sidewall portion of housing 110. Coupling of a given solid-state light source 120 with a given heat sink 121 may help to provide a thermal pathway, for example, between the PCB 124 and the one or more solid-state emitters 122 populated thereon and that heat sink 121, thereby helping to conduct thermal energy away from a given solid-state light source 120 to the ambient environment. To facilitate heat dissipation, a given heat sink 121 may be constructed from any suitable thermally conductive material, such as, for example: (1) aluminum (Al); (2) copper (Cu); (3) brass; (4) steel; (5) a composite and/or polymer (e.g., ceramics, plastics, etc.) doped with thermally conductive material; and/or (6) a combination of any one or more thereof. Other suitable configurations for a given heat sink 121 will depend on a given application and will be apparent in light of this disclosure.

In accordance with some embodiments, the quantity, density, and arrangement of solid-state light sources 120 for a given luminaire 100 may be customized, as desired for a given target application or end-use, and in some instances may be selected based on the dimensions and/or geometry of housing 110. In some embodiments, luminaire 100 may be configured with one or more solid-state light sources 120 arranged over an interior surface 112 thereof. For example, consider FIGS. 12A-12B, which are perspective and cross-sectional views, respectively, of a luminaire 100 configured in accordance with an embodiment of the present disclosure. As can be seen here, one or more solid-state light sources 120*a* may be arranged over an interior surface 112 of housing 110 and configured such that light beams emerging therefrom pass through a given aperture 15 in mounting surface 10. Also, consider FIG. 13, which is a cross-sectional view of a luminaire 100 configured in accordance with another embodiment of the present disclosure. As can be seen here, one or more solid-state light sources 120*b* may be arranged over an interior surface 112 of housing 110 and configured such that light beams emerging therefrom pass through a given aperture 15 in mounting surface 10. As will be appreciated in light of this disclosure, the optical axis of a given solid-state light source 120 mounted anywhere over an interior surface 112 of a housing 110 of hemi-cylindrical shape may be automatically aimed (e.g., by design) at the center line of that hemi-cylindrical luminaire 100. Thus, in some cases in which such a luminaire 100 is mounted over a mounting surface 10, the hemi-cylindrical geometry of that luminaire 100 may allow for use of a relatively narrow aperture 15 (e.g., as long as its solid-state light sources 120 have a sufficiently narrow beam distribution), in accordance with some embodiments.

However, the present disclosure is not so limited only to configurations in which the one or more solid-state light sources 120 of luminaire 100 are arranged over an interior surface 112 of housing 110. For example, consider FIGS. 14A-14B, which are perspective and cross-sectional views, respectively, of a luminaire 100 configured in accordance with another embodiment of the present disclosure. As can be seen here, in some cases, the one or more solid-state light sources 120*a* of luminaire 100 may be arranged, for example, over an exterior surface 114 of housing 110. Also, consider FIG. 15, which is a cross-sectional view of a luminaire 100 configured in accordance with an embodiment of the present disclosure. As can be seen here, in some cases, the one or more solid-state light sources 120*b* of luminaire 100 may be arranged, for example, over an exterior surface 114 of housing 110.

The angular spacing of the solid-state light source(s) 120 of luminaire 100 can be customized to provide any given light beam distribution, as desired for a given target application or end-use, and in some cases may be selected, at least in part, based on the amount of light beam overlap desired for the light distribution produced by luminaire 100. As will be appreciated in light of this disclosure, the wider the angular spacing, the further apart the resultant illumination patterns will be spaced on a given surface of incidence. Conversely, the narrower the angular spacing, the closer together the resultant illumination patterns will be spaced on a given surface of incidence. In some embodiments, luminaire 100 may include a plurality of solid-state light sources 120 arranged over housing 110 with substantially uniform (e.g., precisely uniform or otherwise within a given tolerance) angular spacing. In some other embodiments, luminaire 100 may include a plurality of solid-state light sources 120 arranged over housing 110 with non-uniform angular spacing. In any case, a given solid-state light source 120 may be mounted to or otherwise arranged over a given surface of housing 110, for example, via one or more fasteners, a quantity of thermally conductive adhesive, and/or any other suitable coupling means, as will be apparent in light of this disclosure. Numerous configurations will be apparent in light of this disclosure.

In accordance with some embodiments, the one or more solid-state light sources 120 of luminaire 100 may be electronically coupled with a driver 140. In some cases, driver 140 may be a multi-channel electronic driver configured, for example, for use in controlling one or more solid-state emitters 122 of a given solid-state light source 120. For instance, in some embodiments, driver 140 may be configured to control the on/off state, dimming level, color of emissions, correlated color temperature (CCT), and/or color saturation of a given solid-state emitter 122 (or grouping of emitters 122). To such ends, driver 140 may utilize any of a wide range of driving techniques, including, for example: (1) a pulse-width modulation (PWM) dimming protocol; (2) a current dimming protocol; (3) a triode for alternating current (TRIAC) dimming protocol; (4) a constant current reduction (CCR) dimming protocol; (5) a pulse-frequency modulation (PFM) dimming protocol; (6) a pulse-code modulation (PCM) dimming protocol; (7) a line voltage (mains) dimming protocol (e.g., dimmer is connected before input of driver 140 to adjust AC voltage to driver 140); and/or (8) a combination of any one or more thereof. Other suitable configurations for driver 140 and lighting control/driving techniques will depend on a given application and will be apparent in light of this disclosure.

As will be appreciated in light of this disclosure, a given solid-state light source 120 also may include or otherwise be operatively coupled with other circuitry/componentry, for example, which may be used in solid-state lighting. For instance, a given solid-state light source 120 (and/or host luminaire 100) may be configured to host or otherwise be operatively coupled with any of a wide range of electronic components, such as: (1) power conversion circuitry (e.g., electrical ballast circuitry to convert an AC signal into a DC signal at a desired current and voltage to power a given solid-state light source 120); (2) constant current/voltage driver componentry; (3) transmitter and/or receiver (e.g., transceiver) componentry; and/or (4) internal processing componentry. When included, such componentry may be mounted, for example, on one or more driver 140 boards, in accordance with some embodiments.

Also, as can be seen from FIGS. 16A-16B (discussed below), luminaire 100 may include memory 150 and one or more processor(s) 160. Memory 150 can be of any suitable type (e.g., RAM and/or ROM, or other suitable memory) and size, and in some cases may be implemented with volatile memory, non-volatile memory, or a combination thereof. A given processor 160 of luminaire 100 may be configured as typically done, and in some embodiments may be configured, for example, to perform operations associated with luminaire 100 and one or more of the modules thereof (e.g., within memory 150 or elsewhere). In some cases, memory 150 may be configured to be utilized, for example, for processor workspace (e.g., for one or more processors 160) and/or to store media, programs, applications, and/or content on a host luminaire 100 on a temporary or permanent basis.

The one or more modules stored in memory 150 can be accessed and executed, for example, by the one or more processors 160 of luminaire 100. In accordance with some embodiments, a given module of memory 150 can be implemented in any suitable standard and/or custom/proprietary programming language, such as, for example: (1) C; (2) C++; (3) objective C; (4) JavaScript; and/or (5) any other suitable custom or proprietary instruction sets, as will be apparent in light of this disclosure. The modules of memory 150 can be encoded, for example, on a machine-readable medium that, when executed by a processor 160, carries out the functionality of luminaire 100, in part or in whole. The computer-readable medium may be, for example, a hard drive, a compact disk, a memory stick, a server, or any suitable non-transitory computer/computing device memory that includes executable instructions, or a plurality or combination of such memories. Other embodiments can be implemented, for instance, with gate-level logic or an application-specific integrated circuit (ASIC) or chip set or other such purpose-built logic. Some embodiments can be implemented with a microcontroller having input/output capability (e.g., inputs for receiving user inputs; outputs for directing other components) and a number of embedded routines for carrying out the device functionality. In a more general sense, the functional modules of memory 150 (e.g., one or more applications 152, discussed below) can be implemented in hardware, software, and/or firmware, as desired for a given target application or end-use.

In accordance with some embodiments, memory 150 may have stored therein (or otherwise have access to) one or more applications 152. In some instances, luminaire 100 may be configured to receive input, for example, via one or more applications 152 stored in memory 150. Other suitable modules, applications, and data which may be stored in memory 150 (or may be otherwise accessible to luminaire 100) will depend on a given application and will be apparent in light of this disclosure.

Example Installations

Figure 12A:
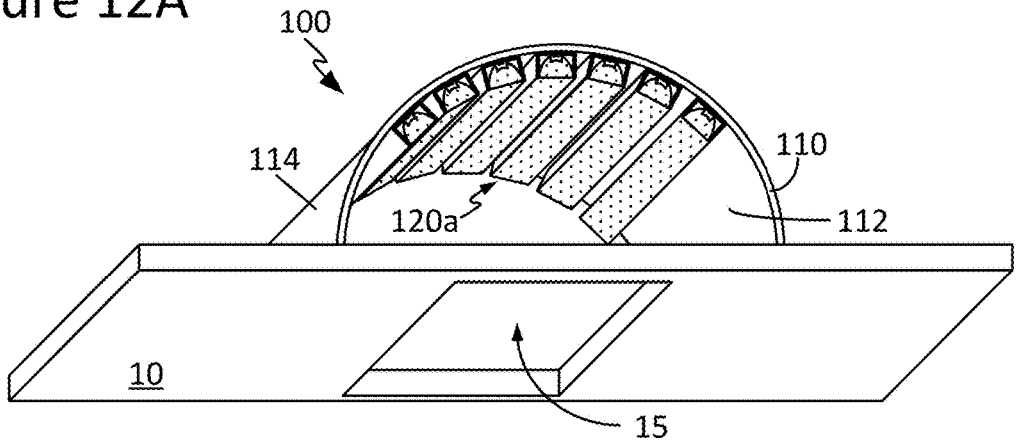
FIG. 12A is a perspective view of a luminaire configured in accordance with an embodiment of the present disclosure.
Figure 12B:
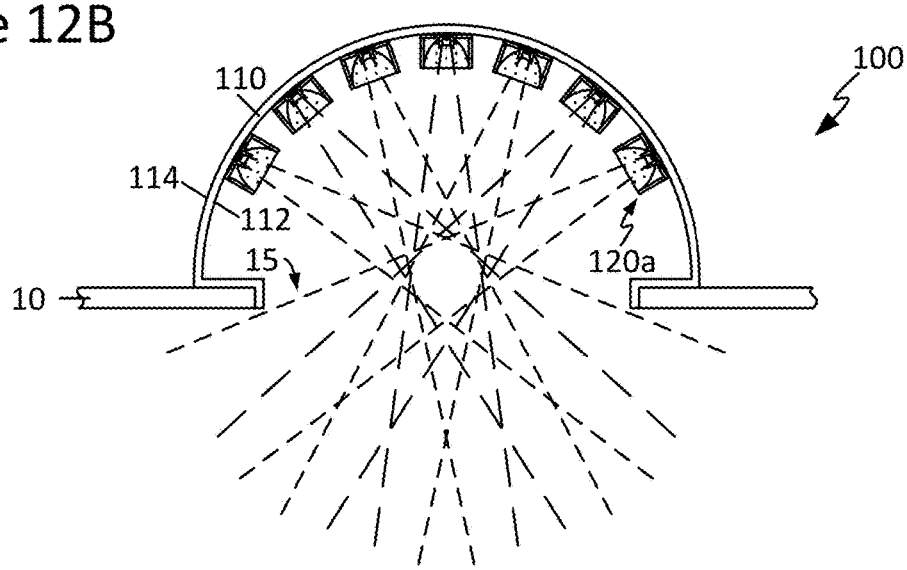
FIG. 12B is a cross-sectional view of the luminaire of FIG. 12A.
Figure 13:
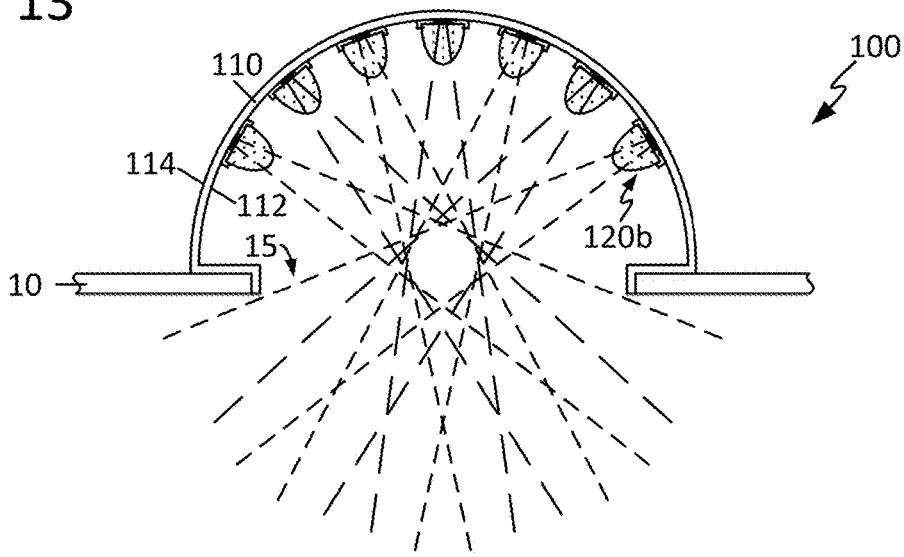
FIG. 13 is a cross-sectional view of a luminaire configured in accordance with another embodiment of the present disclosure.
Figure 14A:
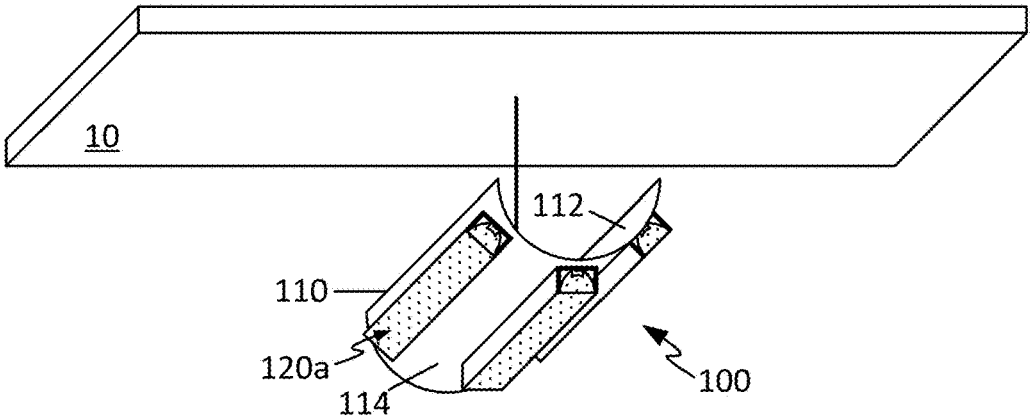
FIG. 14A is a perspective view of a luminaire configured in accordance with an embodiment of the present disclosure.
Figure 14B:
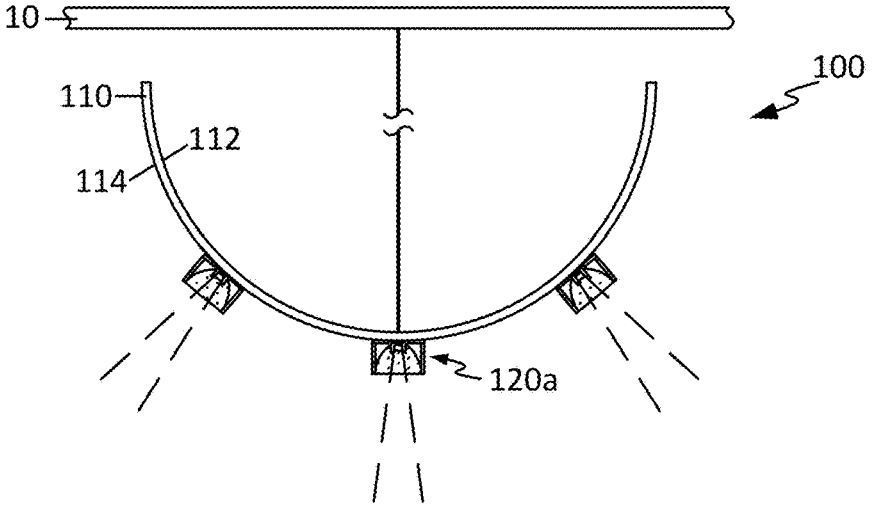
FIG. 14B is a cross-sectional view of the luminaire of FIG. 14A.
Figure 15:
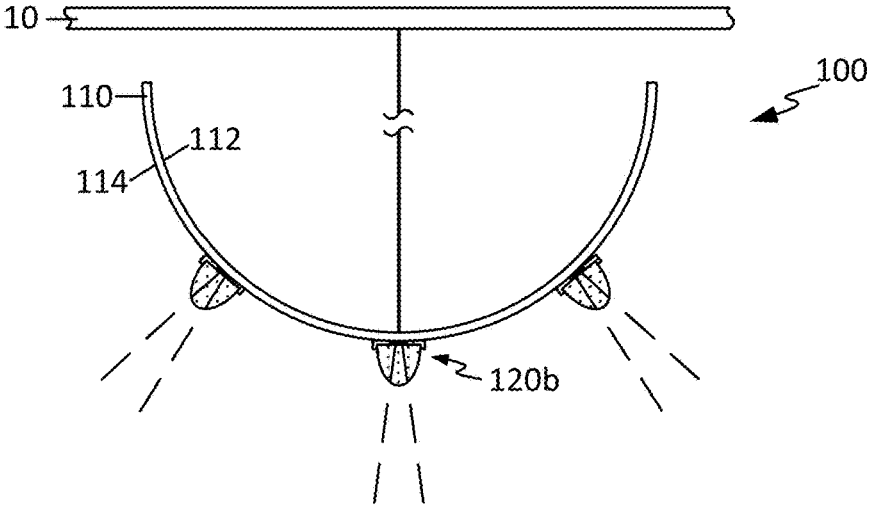
FIG. 15 is a cross-sectional view of a luminaire configured in accordance with another embodiment of the present disclosure.

In accordance with some embodiments, luminaire 100 may be configured, for example, to be mounted over or otherwise fixed to a mounting surface 10 in a temporary or permanent manner, as desired for a given target application or end-use. Some suitable mounting surfaces 10 for luminaire 100 may include, for example, ceilings, walls, floors, and/or steps. In some instances, mounting surface 10 may be a drop ceiling tile (e.g., having an area of about 2 ft.×2 ft., 2 ft.×4 ft., 4 ft.×4 ft., etc.) for installment in a drop ceiling grid. In some cases, luminaire 100 may be in direct physical contact with mounting surface 10, whereas in some other cases, an intermediate structure, such as a support plate, a support rod, or any other suitable support structure, as will be apparent in light of this disclosure, may be disposed between luminaire 100 and mounting surface 10. In accordance with some embodiments, luminaire 100 may be configured, for example, to be mounted to a mounting surface 10 as a recessed lighting fixture (e.g., such as is generally depicted in FIG. 12A). In accordance with some other embodiments, luminaire 100 may be configured, for example, to be mounted to a mounting surface 10 as a pendant-type, sconce-type fixture, or other suspended/extended lighting fixture (e.g., such as is generally depicted in FIG. 14A). It should be noted, however, that luminaire 100 need not be configured to be mounted on a mounting surface 10, as in some other embodiments, luminaire 100 may be configured as a free-standing or otherwise portable lighting device, such as a desk lamp or a torchière lamp, for example. In some embodiments, luminaire 100 may be configured, for example, as a linear lighting fixture. In some embodiments, luminaire 100 may be configured, for example, as a recessed lighting fixture. In some embodiments, luminaire 100 may be configured, for example, as a wall lighting fixture. Numerous suitable configurations for luminaire 100 will be apparent in light of this disclosure.

In some cases, mounting surface 10 may have an aperture 15 formed therein which passes through the thickness of mounting surface 10 (e.g., from a first side to an opposing side thereof). In some instances, mounting surface 10 optionally may have multiple such apertures 15 formed therein. In accordance with some embodiments, luminaire 100 may be positioned or otherwise aligned relative to the aperture(s) 15 in mounting surface 10 such that the light emitted by any one or more of the solid-state light sources 120 emerges from luminaire 100 with minimal or otherwise negligible overlap with the perimeter of a given aperture 15, thus helping to ensure that substantially all of the light emitted by solid-state light source(s) 120 exits luminaire 100. In some instances, aperture 15 may host one or more optical structures (e.g., a diffuser sheet configured to blend beam spots) configured to adjust the output of luminaire 100. Other suitable optical structures which may be hosted by aperture 15, in part or in whole, will depend on a given application and will be apparent in light of this disclosure.

The geometry and size of a given aperture 15 of mounting surface 10 may be customized, as desired for a given target application or end-use. In some instances, a given aperture 15 may be provided with a geometry which substantially corresponds with that of luminaire 100. For example, if housing 110 is hemi-cylindrical, then an associated aperture 15 may be substantially rectangular, in some embodiments. In some cases, aperture 15 may have a length of about 24 inches±12 inches. In some other cases, aperture 15 may have a length of about 36 inches±12 inches. In some still other cases, aperture 15 may have a length of about 48 inches±12 inches. In some instances, a given aperture 15 may have a width/diameter in the range of about 6 inches±4 inches. In some other instances, a given aperture 15 may have a width/diameter of about 12 inches±6 inches. In a more general sense, the geometry and dimensions of a given aperture 15 may be varied, for example, to be commensurate with the geometry and dimensions of luminaire 100 and its particular arrangement of solid-state light source(s) 120. In some cases, aperture 15 may be smaller in size than the distribution area of the solid-state light source(s) 120 of luminaire 100. Thus, in some instances, aperture 15 may be smaller in size than the light field of luminaire 100 (e.g., smaller than the physical distribution area of the solid-state emitters 122). Also, in some cases, a given aperture 15 may be configured such that one or more of the light beams produced by the solid-state light source(s) 120 of luminaire 100 pass through a focal point generally located within that aperture 15. Other suitable geometries and dimensions for a given aperture 15 formed in mounting surface 10 will depend on a given application and will be apparent in light of this disclosure.

Output Control

As previously noted, the solid-state emitters 122 of a given solid-state light source 120 may be configured, in accordance with some embodiments, to be electronically controlled individually and/or in conjunction with one another (e.g., as one or more groupings of emitters 122), for example, to provide highly adjustable light emissions from luminaire 100. More particularly, as previously noted, the solid-state emitters 122 of a given solid-state light source 120 may be configured, in accordance with some embodiments, to be individually addressable and/or addressable in one or more groupings. To that end, a given solid-state light source 120 may include or otherwise be communicatively coupled with one or more controllers 180, in accordance with some embodiments.

Figure 16A:
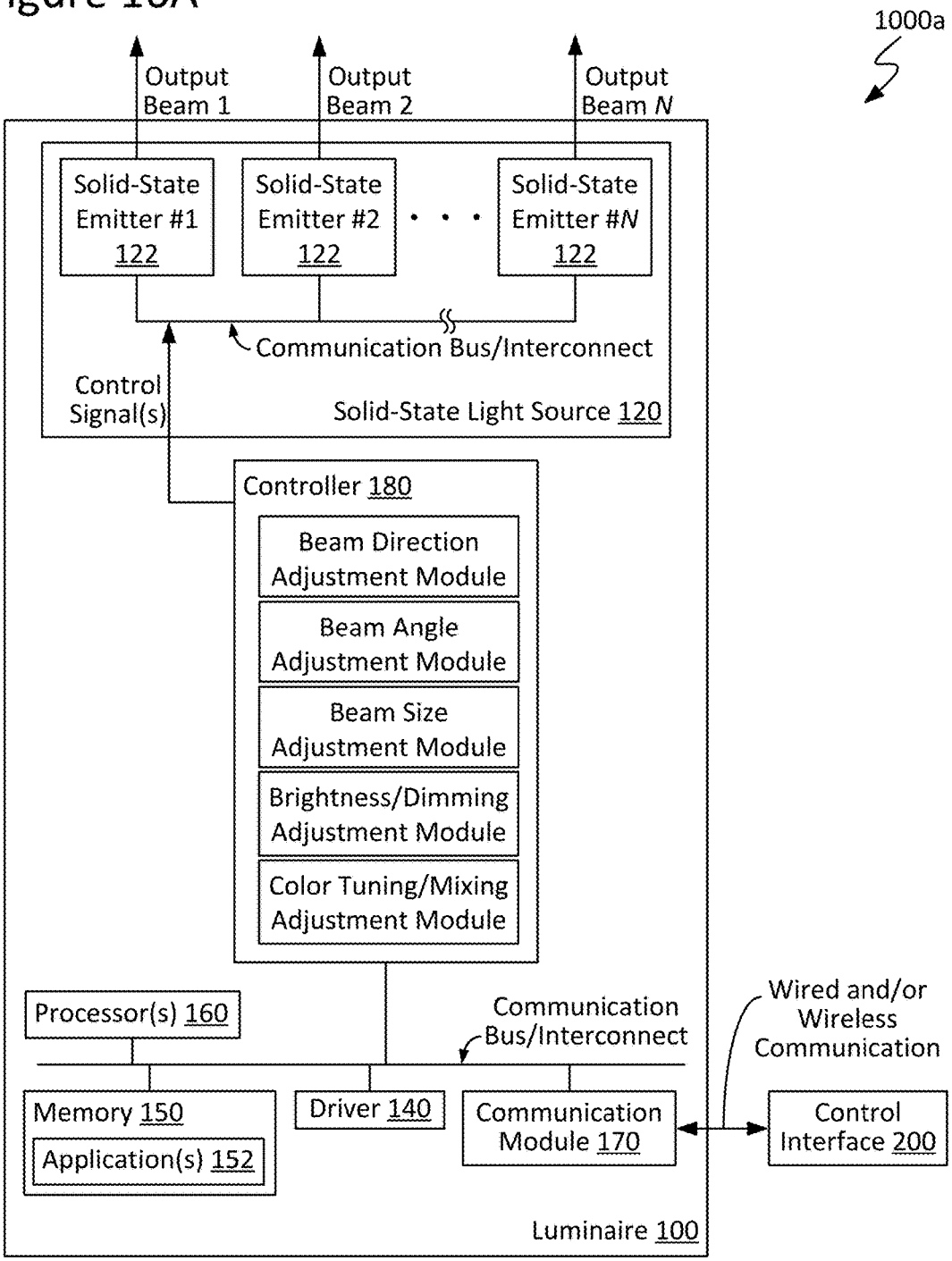
FIG. 16A is a block diagram of a lighting system configured in accordance with an embodiment of the present disclosure.
Figure 16B:
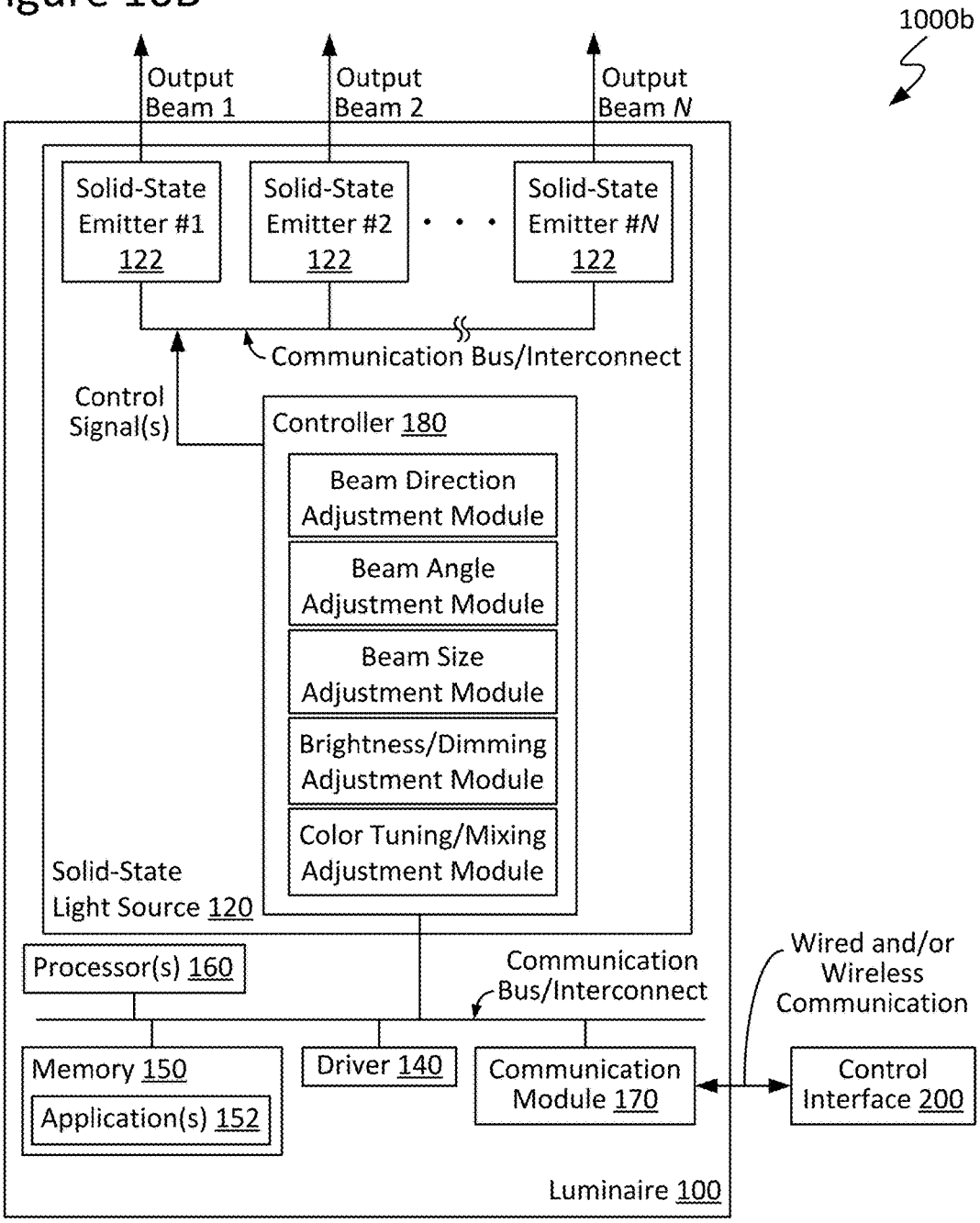
FIG. 16B is a block diagram of a lighting system configured in accordance with another embodiment of the present disclosure.

For example, consider FIG. 16A, which is a block diagram of a lighting system 1000*a* configured in accordance with an embodiment of the present disclosure. Here, a controller 180 is hosted by luminaire 100 and operatively coupled (e.g., via a communication bus/interconnect) with the one or more solid-state emitters 122 (1–N) of a given solid-state light source 120 of luminaire 100. In this example case, controller 180 may output a control signal to any one or more of the solid-state emitters 122 and may do so, for example, based on wired and/or wireless input received from a given source (e.g., such as on-board memory 150 and/or a control interface 200, discussed below). As a result, a given solid-state light source 120 of luminaire 100 may be controlled in such a manner as to output any number of output beams (1–N), which may be varied in beam direction, beam angle, beam size, beam distribution, brightness/dimness, and/or color, as desired for a given target application or end-use.

However, the present disclosure is not so limited. For instance, consider FIG. 16B, which is a block diagram of a lighting system 1000*b* configured in accordance with another embodiment of the present disclosure. Here, a controller 180 is hosted by a given solid-state light source 120 of luminaire 100 and operatively coupled (e.g., via a communication bus/interconnect) with the one or more solid-state emitters 122 (1–N) of that solid-state light source 120. If luminaire 100 includes a plurality of such solid-state light sources 120 hosting their own controllers 180, then each such controller 180 may be considered, in a sense, a mini-controller, providing luminaire 100 with a distributed controller 180. In some embodiments, controller 180 may be populated, for example, on one or more PCBs 124 of the host solid-state light source 120. In this example case, controller 180 may output a control signal to any one or more of the solid-state emitters 122 and may do so, for example, based on wired and/or wireless input received from a given source (e.g., such as on-board memory 150 and/or a control interface 200, discussed below). As a result, a given solid-state light source 120 of luminaire 100 may be controlled in such a manner as to output any number of output beams (1–N), which may be varied in beam direction, beam angle, beam size, beam distribution, brightness/dimness, and/or color, as desired for a given target application or end-use.

In accordance with some embodiments, a given controller 180 may host one or more lighting control modules and can be programmed or otherwise configured to output one or more control signals, for example, to adjust the operation of the one or more solid-state emitters 122 of a given solid-state light source 120. For example, in some cases, a given controller 180 may be configured to output a control signal to control whether the light beam of a given solid-state emitter 122 is on/off, as well as control the beam direction, beam angle, beam distribution, and/or beam diameter of the light emitted by a given solid-state light source 120. In some instances, a given controller 180 may be configured to output a control signal to control the intensity/brightness (e.g., dimming; brightening) of the light emitted by a given solid-state emitter 122. In some cases, a given controller 180 may be configured to output a control signal to control the color (e.g., mixing; tuning) of the light emitted by a given solid-state emitter 122. Thus, if a given solid-state light source 120 includes two or more solid-state emitters 122 configured to emit light having different wavelengths, the control signal may be used to adjust the relative brightness of the different solid-state emitters 122 in order to change the mixed color output by that solid-state light source 120. In some instances in which a given solid-state light source 120 is configured for multi-colored emissions, such a source 120 may be electronically controlled, in accordance with some embodiments, so as to adjust the color of light distributed at different angles and/or directions.

In accordance with some embodiments, a given controller 180 may be configured to communicate (e.g., via communication module 170) utilizing any of a wide range of wired and/or wireless digital communications protocols, including, for example: (1) a digital multiplexer (DMX) interface protocol; (2) a Wi-Fi protocol; (3) a Bluetooth protocol; (4) a digital addressable lighting interface (DALI) protocol; (5) a ZigBee protocol; (6) a KNX protocol; (7) an EnOcean protocol; (8) a TransferJet protocol; (9) an ultra-wideband (UWB) protocol; (10) a WiMAX protocol; (11) a high performance radio metropolitan area network (HiperMAN) protocol; (12) an infrared data association (IrDA) protocol; (13) a Li-Fi protocol; (14) an IPv6 over low power wireless personal area network (6LoWPAN) protocol; (15) a MyriaNed protocol; (16) a WirelessHART protocol; (17) a DASH? protocol; (18) a near field communication (NFC) protocol; (19) a Wavenis protocol; (20) a RuBee protocol; (21) a Z-Wave protocol; (22) an Insteon protocol; (23) a ONE-NET protocol; (24) an X10 protocol; and/or (25) a combination of any one or more thereof. It should be noted, however, that the present disclosure is not so limited to only these example communications protocols, as in a more general sense, and in accordance with some embodiments, any suitable communications protocol, wired and/or wireless, may be utilized by controller 180. In some still other cases, a given controller 180 may be configured as a terminal block or other pass-through such that a given control interface 200 (discussed below) is effectively coupled directly with the individual solid-state emitters 122 of a given solid-state light source 120. Numerous configurations will be apparent in light of this disclosure.

Control of the solid-state light source(s) 120 of luminaire 100 may be provided using any of a wide range of wired and/or wireless control interfaces 200. For example, in some embodiments, one or more switches (e.g., an array of switches) may be utilized to control the solid-state emitters 122 of a given solid-state light source 120 individually and/or in conjunction with one another. A given switch may be of any suitable type (e.g., a sliding switch, a rotary switch, a toggle switch, a push-button switch, etc.), as will be apparent in light of this disclosure. In some instances, one or more switches may be operatively coupled with a given controller 180, which in turn interprets the input and distributes the desired control signal(s) to one or more of the solid-state emitters 122 of a given solid-state light source 120 of luminaire 100. In some other instances, one or more switches may be operatively coupled directly with solid-state emitter(s) 122 to control them directly.

In some embodiments, a touch-sensitive device or surface, such as a touchpad or other device with a touch-based user interface (UI), may be utilized to control the solid-state emitter(s) 122 of a given solid-state light source 120 of luminaire 100 individually and/or in conjunction with one another. In some instances, the touch-sensitive UI may be operatively coupled with one or more controllers 180, which in turn interpret the input from the control interface 200 and provide the desired control signal(s) to one or more of the solid-state emitters 122 of a given solid-state light source 120 of luminaire 100. In some other instances, the touch-sensitive interface may be operatively coupled directly with solid-state emitter(s) 122 to control them directly.

In some embodiments, a computer vision system that is, for example, gesture-sensitive, activity-sensitive, and/or motion-sensitive may be utilized to control the solid-state emitter(s) 122 of a given solid-state light source 120 of luminaire 100 individually and/or in conjunction with one another. In some such cases, this may provide for a luminaire 100 which can automatically adapt its light emissions based on a particular gesture-based command, sensed activity, or other stimulus. In some instances, the computer vision system may be operatively coupled with one or more controllers 180, which in turn interpret the input from the control interface 200 and provide the desired control signal(s) to one or more of the solid-state emitters 122 of a given solid-state light source 120 of luminaire 100. In some other instances, the computer vision system may be operatively coupled directly with solid-state emitter(s) 122 to control them directly. Other suitable configurations and capabilities for a given controller 180 and the one or more control interfaces 200 will depend on a given application and will be apparent in light of this disclosure.

Figure 17A:
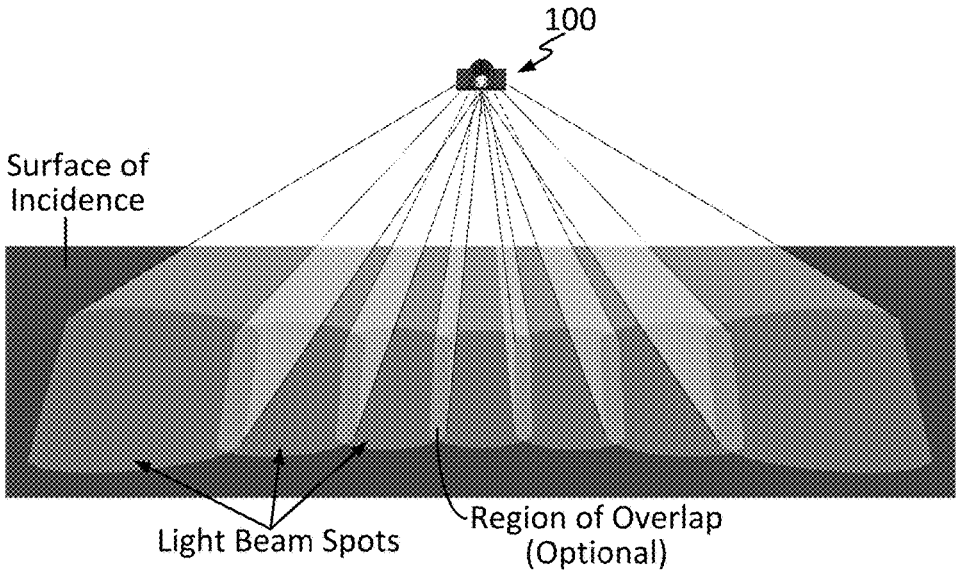
FIG. 17A illustrates an example light beam distribution of a luminaire configured in accordance with an embodiment of the present disclosure.

As previously discussed, the output of the one or more solid-state light sources 120 of luminaire 100 may be dimmed, adjusted in color, and/or otherwise controlled, in accordance with some embodiments, to produce a given light distribution, as desired for a given target application or end-use. FIG. 17A illustrates an example light beam distribution of a luminaire 100 configured in accordance with an embodiment of the present disclosure. As can be seen here, luminaire 100 may be configured to produce bar-like light beam patterns at a given surface of incidence having a given amount of overlap, which may be customized, as desired for a given target application or end-use. To that end, luminaire 100 may include, in accordance with some embodiments, optic(s) 126 configured, for example, like those discussed above with respect to FIGS. 5A-5B. In accordance with some embodiments, the individual bar-like light beam patterns of luminaire 100 can be controlled individually and/or in one or more groupings to provide a given desired light distribution at a given surface of incidence.

Figure 17B:
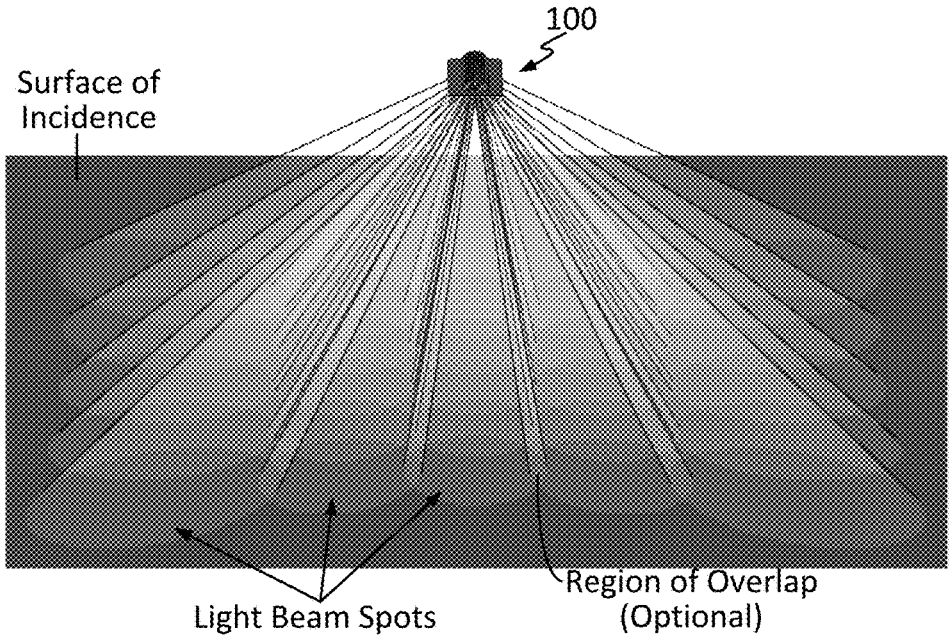
FIG. 17B illustrates an example light beam distribution of a luminaire configured in accordance with another embodiment of the present disclosure.

FIG. 17B illustrates an example light beam distribution of a luminaire 100 configured in accordance with another embodiment of the present disclosure. As can be seen here, in some embodiments, luminaire 100 may be configured to produce an array of light beam spots having a given amount of overlap, which may be customized, as desired for a given target application or end-use. To that end, luminaire 100 may include, in accordance with some embodiments: (1) optic(s) 126 configured, for example, like those discussed above with respect to FIGS. 10A-10B; and/or (2) a substrate 130 having one or more pre-positioning portions 132 like that discussed above with respect to FIG. 9. In accordance with some embodiments, the individual light beam spots of luminaire 100 can be controlled individually and/or in one or more groupings to provide a given desired light distribution at a given surface of incidence.

In some embodiments, luminaire 100 may be configured, for example, such that no two of its solid-state light sources 120 are pointed at the same spot on a given surface of incidence. Thus, there may be a one-to-one mapping of the solid-state light sources 120 of luminaire 100 to the light beam spots which it may produce on a given surface of incidence. This one-to-one mapping may provide for pixelated control over the light distribution of luminaire 100, in accordance with some embodiments. That is, luminaire 100 may be capable of outputting a polar, grid-like pattern of light beam spots which can be manipulated (e.g., in intensity, size, etc.), for instance, like the regular, rectangular grid of pixels of a display. Like the pixels of a display, the light beam spots produced by luminaire 100 can have minimal, maximal, or other targeted amount of overlap, as desired, in accordance with some embodiments. This may allow for the light distribution of luminaire 100 to be manipulated in a manner similar to the way that the pixels of a display can be manipulated to create different patterns, spot shapes, and distributions of light, in accordance with some embodiments. Furthermore, luminaire 100 may exhibit minimal or otherwise negligible overlap of the angular distributions of light of its solid-state light sources 120, and thus the light distribution of luminaire 100 can be adjusted (e.g., in intensity, size, etc.) as desired for a given target application or end-use. As will be appreciated in light of this disclosure, however, luminaire 100 also may be configured to provide for pointing two or more solid-state light sources 120 at the same spot (e.g., such as when color mixing is desired), in accordance with some embodiments. In a more general sense, and in accordance with some embodiments, the solid-state light sources 120 may be mounted on a given interior surface 112 or exterior surface 114 of housing 110 such that their orientation provides a given desired light beam distribution from luminaire 100.

Numerous embodiments will be apparent in light of this disclosure. One example embodiment provides a luminaire including: a housing; a plurality of solid-state light sources arranged over a contour of the housing, wherein at least one of the solid-state light sources includes: a substrate configured to conform to the contour of the housing; one or more solid-state emitters populated over the substrate; and one or more optics optically coupled with the one or more solid-state emitters; and one or more heat sinks arranged over the housing and thermally coupled with at least one of the plurality of solid-state light sources and the substrate. In some cases, the housing is hemi-cylindrical, oblate hemi-cylindrical, oblong elliptical, or polyhedral in shape, and the contour over which the plurality of solid-state light sources is arranged is an interior surface of the housing. In some other cases, the housing is hemi-cylindrical, oblate hemi-cylindrical, oblong elliptical, or polyhedral in shape, and the contour over which the plurality of solid-state light sources is arranged is an exterior surface of the housing. In some instances, the housing is configured with a hemi-cylindrical interior surface, and the hemi-cylindrical interior surface is the contour over which the plurality of solid-state light sources is arranged. In some other instances, the housing is configured with at least one planar interior surface, and the at least one planar interior surface is the contour over which the plurality of solid-state light sources is arranged. In some instances, the housing is configured with a hemi-cylindrical exterior surface, and the hemi-cylindrical exterior surface is the contour over which the plurality of solid-state light sources is arranged. In some other instances, the housing is configured with at least one planar exterior surface, and the at least one planar exterior surface is the contour over which the plurality of solid-state light sources is arranged. In some cases, the one or more solid-state emitters of the at least one solid-state light source is a plurality of solid-state emitters, and at least one of that plurality of solid-state emitters is individually addressable. In some cases, the one or more solid-state emitters of the at least one solid-state light source is a plurality of solid-state emitters, and that plurality of solid-state emitters is addressable in one or more groupings. In some instances, the one or more solid-state emitters of the at least one solid-state light source is a plurality of solid-state emitters, and the one or more optics is a single optical structure shared by that plurality of solid-state emitters. In some other instances, the one or more solid-state emitters of the at least one solid-state light source is a plurality of solid-state emitters, and the one or more optics is a plurality of optical structures, each of which is optically coupled with its own solid-state emitter. In some cases, interconnecting circuitry of the plurality of solid-state light sources is at least one of formed on and formed within the substrate. In some instances, the substrate includes a thermoplastic polymer or a sheet metal. In some cases, the substrate is articulated. In some instances, the substrate includes one or more pre-positioning portions over which the one or more solid-state emitters are populated. In some cases, the luminaire further includes a controller configured for communicative coupling with at least one of the plurality of solid-state light sources and configured to output a control signal to electronically control light emitted thereby. In some such cases, the controller is configured to electronically control the plurality of solid-state light sources at least one of independently and in one or more groupings. In some other such cases, the controller is configured to control at least one of beam direction, beam angle, beam diameter, beam distribution, brightness, and color of light emitted by the at least one solid-state light source. In some other such cases, the controller is configured to utilize at least one of a digital multiplexer (DMX) interface protocol, a Wi-Fi protocol, a Bluetooth protocol, a digital addressable lighting interface (DALI) protocol, a ZigBee protocol, a KNX protocol, an EnOcean protocol, a TransferJet protocol, an ultra-wideband (UWB) protocol, a WiMAX protocol, a high performance radio metropolitan area network (HiperMAN) protocol, an infrared data association (IrDA) protocol, a Li-Fi protocol, an IPv6 over low power wireless personal area network (6LoWPAN) protocol, a MyriaNed protocol, a WirelessHART protocol, a DASH7 protocol, a near field communication (NFC) protocol, a Wavenis protocol, a RuBee protocol, a Z-Wave protocol, an Insteon protocol, a ONE-NET protocol, and an X10 protocol. In some instances, the luminaire further includes a driver configured to be operatively coupled with at least one of the plurality of solid-state light sources and configured to adjust at least one of an on/off state, a brightness level, a color of emissions, a correlated color temperature (CCT), and a color saturation thereof. In some such instances, the driver is configured to utilize at least one of pulse-width modulation (PWM) dimming, current dimming, triode for alternating current (TRIAC) dimming, constant current reduction (CCR) dimming, pulse-frequency modulation (PFM) dimming, pulse-code modulation (PCM) dimming, and line voltage (mains) dimming.

Another example embodiment provides a luminaire including: a hemi-cylindrical housing; a plurality of solid-state light sources arranged over a contour of the housing, wherein at least one of the solid-state light sources includes: a substrate configured to conform to the contour of the hemi-cylindrical housing; one or more light-emitting diodes (LEDs) populated on one or more printed circuit boards (PCBs) disposed over the substrate; and one or more optics optically coupled with the one or more LEDs; wherein interconnecting circuitry of the plurality of solid-state light sources is at least one of formed on and formed within the substrate; and one or more heat sinks arranged over the hemi-cylindrical housing and thermally coupled with the plurality of solid-state light sources through a sidewall portion of the hemi-cylindrical housing. In some cases, the luminaire further includes a controller configured for communicative coupling with at least one of the plurality of solid-state light sources and configured to output a control signal to electronically control light emitted thereby. In some instances, the luminaire is configured to be mounted on a mounting surface having an aperture formed therein; the plurality of solid-state light sources is arranged over an interior surface of the hemi-cylindrical housing so as to provide a light source distribution area; each of the plurality of solid-state light sources is configured to emit light through the aperture; and the aperture is smaller in size than the distribution area of the plurality of solid-state light sources on the interior surface of the hemi-cylindrical housing. In some such cases, the housing has a length of about 48 inches±12 inches and a radius of about 6 inches±2 inches, and the aperture of the mounting surface has a length of about 48 inches±12 inches and a width/diameter of about 6 inches±4 inches. In some instances, the luminaire is configured as a free-standing lighting device.

Another example embodiment provides a lighting system including: a luminaire including: a housing of hemi-cylindrical, oblate hemi-cylindrical, oblong elliptical, or polyhedral shape; a plurality of light-emitting diode (LED)-based light sources arranged over a contour of the housing, wherein at least one of the LED-based light sources includes: a substrate configured to conform to the contour of the housing; a strip of solid-state emitters populated over the substrate; one or more printed circuit boards (PCBs) disposed between the strip of solid-state emitters and the substrate; and one or more optics optically coupled with the strip of solid-state emitters; one or more heat sinks arranged over the housing and thermally coupled with the plurality of LED-based light sources through a sidewall portion of the housing; and a driver configured to be operatively coupled with the plurality of LED-based light sources and configured to adjust at least one of an on/off state, a brightness level, a color of emissions, a correlated color temperature (CCT), and a color saturation thereof; and a controller configured for communicative coupling with the plurality of LED-based light sources and configured to output a control signal to electronically control light emitted thereby. In some cases, the controller is configured to electronically control the plurality of LED-based light sources at least one of independently and in one or more groupings. In some instances, the controller is configured to control at least one of beam direction, beam angle, beam diameter, beam distribution, brightness, and color of light emitted by the plurality of LED-based light sources. In some cases, the driver is configured to utilize at least one of pulse-width modulation (PWM) dimming, current dimming, triode for alternating current (TRIAC) dimming, constant current reduction (CCR) dimming, pulse-frequency modulation (PFM) dimming, pulse-code modulation (PCM) dimming, and line voltage (mains) dimming.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A luminaire comprising:

a housing;

a plurality of solid-state light sources arranged over a contour of the housing, wherein at least one of the solid-state light sources comprises:

a substrate configured to conform to the contour of the housing;

one or more solid-state emitters populated over the substrate; and one or more optics optically coupled with the one or more solid-state emitters;

one or more heat sinks arranged over the housing and thermally coupled with at least one of the plurality of solid-state light sources and the substrate; and a controller communicatively coupled with the plurality of solid-state light sources and configured to electronically control a beam direction emitted by each of the plurality of solid-state light sources independently or in one or more groupings, wherein the controller is configured to achieve color mixing at a given spot by electronically controlling the beam direction of two or more of the plurality of solid-state light sources to point to the given spot.

2. The luminaire of claim 1, wherein the housing is hemi-cylindrical, oblate hemi-cylindrical, oblong elliptical, or polyhedral in shape, and wherein the contour over which the plurality of solid-state light sources is arranged is an interior surface of the housing.

3. The luminaire of claim 1, wherein the housing is hemi-cylindrical, oblate hemi-cylindrical, oblong elliptical, or polyhedral in shape, and wherein the contour over which the plurality of solid-state light sources is arranged is an exterior surface of the housing.

4. The luminaire of claim 1, wherein the housing is configured with a hemi-cylindrical interior surface, and wherein the hemi-cylindrical interior surface is the contour over which the plurality of solid-state light sources is arranged.

5. The luminaire of claim 1, wherein the housing is configured with at least one planar interior surface, and wherein the at least one planar interior surface is the contour over which the plurality of solid-state light sources is arranged.

6. The luminaire of claim 1, wherein the housing is configured with a hemi-cylindrical exterior surface, and wherein the hemi-cylindrical exterior surface is the contour over which the plurality of solid-state light sources is arranged.

7. The luminaire of claim 1, wherein the housing is configured with at least one planar exterior surface, and wherein the at least one planar exterior surface is the contour over which the plurality of solid-state light sources is arranged.

8. The luminaire of claim 1, wherein the one or more solid-state emitters of the at least one solid-state light source is a plurality of solid-state emitters, and wherein at least one of that plurality of solid-state emitters is individually addressable.

9. The luminaire of claim 1, wherein the one or more solid-state emitters of the at least one solid-state light source is a plurality of solid-state emitters, and wherein that plurality of solid-state emitters is addressable in one or more groupings.

10. The luminaire of claim 1, wherein the one or more solid-state emitters of the at least one solid-state light source is a plurality of solid-state emitters, and wherein the one or more optics is a single optical structure shared by that plurality of solid-state emitters.

11. The luminaire of claim 1, wherein the one or more solid-state emitters of the at least one solid-state light source is a plurality of solid-state emitters, and wherein the one or more optics is a plurality of optical structures, each of which is optically coupled with its own solid-state emitter.

12. The luminaire of claim 1, wherein interconnecting circuitry of the plurality of solid-state light sources is at least one of formed on and formed within the substrate.

13. The luminaire of claim 1, wherein the substrate comprises a thermoplastic polymer or a sheet metal.

14. The luminaire of claim 1, wherein the substrate is articulated.

15. The luminaire of claim 1, wherein the substrate includes one or more pre-positioning portions over which the one or more solid-state emitters are populated.

16. The luminaire of claim 1, wherein the controller is further configured to control at least one of beam angle, beam diameter, beam distribution, brightness, and color of light emitted by the at least one solid-state light source.

17. The luminaire of claim 1, wherein the controller is configured to utilize at least one of a digital multiplexer (DMX) interface protocol, a Wi-Fi protocol, a Bluetooth protocol, a digital addressable lighting interface (DALI) protocol, a ZigBee protocol, a KNX protocol, an EnOcean protocol, a TransferJet protocol, an ultra-wideband (UWB) protocol, a WiMAX protocol, a high performance radio metropolitan area network (HiperMAN) protocol, an infrared data association (IrDA) protocol, a Li-Fi protocol, an IPv6 over low power wireless personal area network (6LoWPAN) protocol, a MyriaNed protocol, a WirelessHART protocol, a DASH7 protocol, a near field communication (NFC) protocol, a Wavenis protocol, a RuBee protocol, a Z-Wave protocol, an Insteon protocol, a ONE-NET protocol, and an X10 protocol.

18. The luminaire of claim 1 further comprising a driver configured to be operatively coupled with at least one of the plurality of solid-state light sources and configured to adjust at least one of an on/off state, a brightness level, a color of emissions, a correlated color temperature (CCT), and a color saturation thereof.

19. The luminaire of claim 18, wherein the driver is configured to utilize at least one of pulse-width modulation (PWM) dimming, current dimming, triode for alternating current (TRIAC) dimming, constant current reduction (CCR) dimming, pulse-frequency modulation (PFM) dimming, pulse-code modulation (PCM) dimming, and line voltage (mains) dimming.

20. A luminaire comprising:

a hemi-cylindrical housing;

a plurality of solid-state light sources arranged over a contour of the housing, wherein at least one of the solid-state light sources comprises:

a substrate configured to conform to the contour of the hemi-cylindrical housing;

one or more light-emitting diodes (LEDs) populated on one or more printed circuit boards (PCBs) disposed over the substrate; and one or more optics optically coupled with the one or more LEDs;

wherein interconnecting circuitry of the plurality of solid-state light sources is at least one of formed on and formed within the substrate;

one or more heat sinks arranged over the hemi-cylindrical housing and thermally coupled with the plurality of solid-state light sources through a sidewall portion of the hemi-cylindrical housing; and a controller communicatively coupled with the plurality of solid-state light sources and configured to electronically control a beam direction emitted by each of the plurality of solid-state light sources independently or in one or more groupings, wherein the controller is configured to achieve color mixing at a given spot by electronically controlling the beam direction of two or more of the plurality of solid-state light sources to point to the given spot.

21. The luminaire of claim 20, wherein:

the luminaire is configured to be mounted on a mounting surface having an aperture formed therein;

the plurality of solid-state light sources is arranged over an interior surface of the hemi-cylindrical housing so as to provide a light source distribution area;

each of the plurality of solid-state light sources is configured to emit light through the aperture; and the aperture is smaller in size than the distribution area of the plurality of solid-state light sources on the interior surface of the hemi-cylindrical housing.

22. The luminaire of claim 21, wherein the housing has a length of about 48 inches±12 inches and a radius of about 6 inches±2 inches, and wherein the aperture of the mounting surface has a length of about 48 inches±12 inches and a width/diameter of about 6 inches±4 inches.

23. A lighting system comprising:

a luminaire comprising:

a housing of hemi-cylindrical, oblate hemi-cylindrical, oblong elliptical, or polyhedral shape;

a plurality of light-emitting diode (LED)-based light sources arranged over a contour of the housing, wherein at least one of the LED-based light sources comprises:

a substrate configured to conform to the contour of the housing;

a strip of solid-state emitters populated over the substrate;

one or more printed circuit boards (PCBs) disposed between the strip of solid-state emitters and the substrate; and one or more optics optically coupled with the strip of solid-state emitters;

one or more heat sinks arranged over the housing and thermally coupled with the plurality of LED-based light sources through a sidewall portion of the housing; and a driver configured to be operatively coupled with the plurality of LED-based light sources and configured to adjust at least one of an on/off state, a brightness level, a color of emissions, a correlated color temperature (CCT), and a color saturation thereof; and a controller communicatively coupled with the plurality of LED-based light sources and configured to electronically control a beam direction emitted by each of the plurality of LED-based light sources independently or in one or more groupings, wherein the controller is configured to achieve color mixing at a given spot by electronically controlling the beam direction of two or more of the plurality of LED-based light sources to point to the given spot.

* * * * *